US012618245B2

(12) United States Patent
Eschlbeck

(10) Patent No.: US 12,618,245 B2
(45) Date of Patent: May 5, 2026

(54) PANEL

(71) Applicant: Franz Eschlbeck, Prien am Chiemsee (DE)

(72) Inventor: Franz Eschlbeck, Prien am Chiemsee (DE)

( * ) Notice: Subject to any disclaimer, the term of this patent is extended or adjusted under 35 U.S.C. 154(b) by 511 days.

(21) Appl. No.: 17/922,893

(22) PCT Filed: May 5, 2021

(86) PCT No.: PCT/IB2021/053774
§ 371 (c)(1),
(2) Date: Nov. 2, 2022

(87) PCT Pub. No.: WO2021/224810
PCT Pub. Date: Nov. 11, 2021

(65) Prior Publication Data

US 2023/0160217 A1 May 25, 2023

(30) Foreign Application Priority Data

May 5, 2020 (DE) ..... 20 2020 102 526.0
May 5, 2020 (EP) ..... 20173023

(51) Int. Cl.
*E04F 15/02* (2006.01)

(52) U.S. Cl.
CPC ..... *E04F 15/02038* (2013.01); *E04F 2201/0107* (2013.01); *E04F 2201/023* (2013.01); *E04F 2201/043* (2013.01)

(58) Field of Classification Search
CPC ..... E04F 15/02038; E04F 2201/0107; E04F 2201/023; E04F 2201/043; E04F 15/0105; E04F 2201/146; E04F 2201/042
USPC ..... 52/582.1, 582.2, 586.1, 586.2, 588.1, 52/590.1–590.3, 592.1, 592.4
See application file for complete search history.

(56) References Cited

U.S. PATENT DOCUMENTS 1,787,027 A * 12/1930 Wasleff ..... E04F 15/04 52/591.1
2,187,672 A * 1/1940 Wedberg ..... E04F 15/04 52/591.1
6,101,778 A * 8/2000 M.ang.rtensson ..... E04F 15/02 52/592.1
6,421,970 B1 * 7/2002 Martensson ..... E04F 13/0878 52/592.1

(Continued)

FOREIGN PATENT DOCUMENTS

DE 20208058 U1 8/2002
DE 69817781 T2 7/2004

(Continued)

OTHER PUBLICATIONS

Search Report from corresponding European Application No. 20173023.1, Oct. 23, 2020.

(Continued)

*Primary Examiner* — Brian E Glessner
*Assistant Examiner* — Adam G Barlow
(74) *Attorney, Agent, or Firm* — Workman Nydegger

(57) ABSTRACT

A rectangular panel includes four edges each provided with continuous coupling profiles. The coupling profiles enable to couple a plurality of such panels. The panels and the coupling profiles are configured such that only one type of panel is required to install the panels in herringbone configuration.

19 Claims, 21 Drawing Sheets

(56) References Cited

U.S. PATENT DOCUMENTS

| | | | | |
|---|---|---|---|---|
| 7,854,100 | B2 * | 12/2010 | Pervan | B44C 5/0492 52/177 |
| 7,908,816 | B2 | 3/2011 | Grafenauer et al. | |
| 8,353,140 | B2 * | 1/2013 | Pervan | H01F 7/0252 52/578 |
| 8,615,952 | B2 * | 12/2013 | Engstrom | E04F 15/02038 52/489.2 |
| 9,809,983 | B2 * | 11/2017 | Trudel | E04F 15/04 |
| 10,100,531 | B2 * | 10/2018 | Devos | E04F 15/10 |
| 10,808,410 | B2 * | 10/2020 | Boo | E04F 15/02033 |
| 11,608,646 | B2 * | 3/2023 | Schäfers | E04F 15/102 |
| 2003/0041545 | A1 * | 3/2003 | Stanchfield | E04F 15/02 52/592.1 |
| 2003/0154681 | A1 * | 8/2003 | Pletzer | E04F 15/04 52/592.1 |
| 2005/0050827 | A1 * | 3/2005 | Schitter | E04F 15/02 52/578 |
| 2005/0247000 | A1 * | 11/2005 | Zhu | E04F 15/02 52/588.1 |
| 2007/0028547 | A1 * | 2/2007 | Grafenauer | F16B 5/002 52/586.1 |
| 2010/0018149 | A1 * | 1/2010 | Thiers | E04F 15/02 52/588.1 |
| 2010/0043333 | A1 * | 2/2010 | Hannig | F16B 5/0056 52/582.2 |
| 2011/0138722 | A1 * | 6/2011 | Hannig | E04F 15/02033 52/309.1 |
| 2019/0063077 | A1 * | 2/2019 | De Rick | E04F 15/04 |
| 2019/0136545 | A1 | 5/2019 | De Rick et al. | |
| 2022/0010563 | A1 * | 1/2022 | Schacht | B32B 3/10 |

FOREIGN PATENT DOCUMENTS

| | | | |
|---|---|---|---|
| DE | 202019103690 | U1 | 8/2019 |
| EP | 3128102 | A1 | 2/2017 |
| WO | 2004085765 | A1 | 10/2004 |
| WO | 2005098163 | A1 | 10/2005 |

OTHER PUBLICATIONS

International Search Report from PCT Application No. PCT/IB2021/053774, Jun. 1, 2021.

* cited by examiner

PANEL

BACKGROUND

The invention relates to a panel comprising coupling parts. The panel is rectangular. The panel comprises a plurality of coupling parts which enables the panels to be installed in complex installation patterns, such as herringbone patterns, without it being required to have more than one type of panels.

It is state of the art that all four edges of rectangular panels are provided with grooves; or that the long edges are provided with standard tongue and groove and that both short edges are provided with grooves. Via insertion of separate inserts two different types of panels can be obtained. This allows easy stockkeeping but installation involves high costs. Herringbone patterns can only be installed by modifying the edge profiles during installation of the panels, and therefore involves expensive installation.

DE69817781 shows a herringbone installation using only one type of panels, wherein the panel is provided at the opposite long edges with standard tongue profiles. The tongue profiles are removed at certain distances from each other and replaced by grooves, such that a mirror image of the coupling parts is obtained. Both short edges are provided with a standard groove profile. The production of such panel is rather complex. The productivity is rather low, as no large production speed is possible due to the complex structure of the coupling parts.

In U.S. Pat. No. 2,187,672A, three layers are glued onto each other, such that at half of the long edge a groove is provided and that at the other half of the long edge a tongue is provided. The two long edges are provided in mirror image. The short edges are provided with a standard tongue and groove profile. The production of such panels is difficult, and the productivity is low. It is possible to install the panels in herringbone pattern or parallel to each other using only one type of panels.

EP3128102A1 discloses a panel wherein one long edge comprises a continuous standard groove profile and the other long edge comprises a standard tongue profile which is interrupted at both ends of the panel. The standard tongue profile is replaced by a groove profile at the interruptions. Both short edges are provided with a standard tongue profile. A herringbone installation can be made with only one type of panels. The production of such panels is difficult, and the productivity is low.

U.S. Pat. No. 1,787,027A discloses a standard tongue and groove coupling. The groove profile is provided at one long edge and at one short edge; whereas the tongue profile is provided at the opposite long and short edges. A herringbone installation is only possible using two different types of panels. These panels have a number of drawbacks: the production of two different types of panels requires double stock keeping, the risk of taking the wrong panel, increased complexity of installation of the panels and increased costs.

DE20208058U1 also discloses a herringbone installation pattern. However, distinct right hand side and left hand side panels are required. These panels also have as drawbacks: the production of two different types of panels requires double stock keeping, the risk of taking the wrong panel, increased complexity of installation of the panels and increased costs.

WO2005/098163A1 discloses a panel comprising coupling parts with locking elements enabling a herringbone installation pattern with only one type of panels.

SUMMARY

It is an objective of the invention to provide panels that are easy to manufacture and that can be installed in complex and different installation patterns, including herringbone patterns, requiring only one type of panels. It is an objective of at least embodiments of the invention that a stable installation can be obtained. It is a further objective of at least embodiments of the invention that the panels can be installed easily.

It is a specific objective of the invention to provide panels with tongue and groove coupling means such that complex installation patterns—e.g. installation patterns wherein the panels are installed in a 90° angle configuration such as in herringbone patterns—are possible using only one type of panels. It is an objective of the invention to provide such panels that can be easily manufactured with a minimum of manufacturing operations.

The invention is described by the independent claims. The dependent claims provide preferred embodiments of the invention.

The first aspect of the invention relates to a panel, wherein the panel is rectangular, wherein the panel comprises a first edge and a third edge, wherein the first edge and the third edges are provided opposite to each other, wherein the panel comprises a second edge and a fourth edge wherein the second edge and the fourth edge are provided opposite to each other, wherein each of the first edge, the second edge, the third edge and the fourth edge comprise a profile selected from a first profile, a second profile and a third profile. The first profile comprises or consists of a groove-tongue profile, wherein the tongue-groove profile comprises a continuous groove having a groove width and a groove depth, and a continuous tongue having different tongue thicknesses and tongue lengths.

The second profile comprises or consists of a groove profile comprising a continuous groove having different groove widths and different groove depths.

The third profile comprises or consists of a groove-double tongue profile, wherein the groove-double tongue profile comprises a continuous groove having a groove width, wherein the groove-double tongue profile comprises a continuous double tongue having different tongue thicknesses and having different tongue lengths.

Two opposite edges comprise the same profile selected from the first profile, the second profile or the third profile.

It is a benefit of the invention that complex installation patterns—e.g. herringbone patterns—can be made using only one type of panels.

The first profile (which is a groove-double tongue profile) has a double function, the function of a tongue and the function of a groove, as it fits in second profile as well as in the third profile. The first profile, the second profile and the third profile show in the direction perpendicular to the panel surface three levels.

The manufacturing of the panels is facilitated as a minimum amount of tooling is required and no complex machinery is required for milling the panel edges. Using continuous profiles along the full length of the panel edges—with a constant cross section of the profiles—facilitates manufacturing as the milling machines do not need special control mechanisms to vary the profile along the length of the panel edge. The cross section of each of the three profiles is rather simple, facilitating the manufacturing process; and making it possible that the profiles can be milled in rather thin panels, as the more complex the profile cross section, the thicker the panel must be for providing the profiles with good quality. Therefore, the invention allows to provide panels with limited thickness, that are easy to produce and that only require one type of panels for installing herringbone profiles.

According to the first aspect of the invention, two opposite edges comprise the same profile selected from the first profile, the second profile or the third profile. It means that two opposite edges comprise or the first profile or the second profile or the third profile. It does not mean that the profiles at these two opposite edges must be identical—which however is not excluded—but that the profiles at both opposite edge both fulfill the features of the first profile, or both fulfill the features of the second profile, or both fulfill the features of the third profile.

In a preferred embodiment of the first aspect of the invention, each of the first profile, the second profile and the third profile are configured such that they can be realized by milling operations with milling axis perpendicular to the surface of the panel. This further facilitates the production process of the panels.

In a preferred embodiment of the first aspect of the invention, the continuous tongue of the groove-tongue profile comprises two different end faces, preferably wherein the two different end faces are provided at different distances from the panel edge where the first profile is provided, more preferably wherein the two end face comprise an end surface substantially perpendicular to or perpendicular to the panel surface.

Such embodiments provide improved locking in vertical direction, whereas the panels can be manufactured easily.

In a preferred embodiment of the first aspect of the invention, the continuous groove of the third profile has different groove depths.

In a preferred embodiment of the first aspect of the invention, the continuous double tongue of the groove-double tongue profile has different tongue thicknesses and/or has different tongue lengths.

In a preferred embodiment of the first aspect of the invention, the groove widths of the grooves of the groove-tongue profile, the groove-double tongue profile and the groove profile are configured; and the corresponding tongues of a to be coupled groove-tongue profile and/or a to be coupled groove-double tongue profile are configured such that the panels can be coupled at the upper side and/or at the bottom side of the panel in a form fitting manner. This way the panels are coupled and the panels lie with their edges flush to each other and locked against shifting. The coupled edges are locking in the direction perpendicular to the panel surface, preferably the coupled edges are not mechanically locked in the direction perpendicular to the coupled panel edges and parallel to the panel surface.

In a preferred embodiment of the first aspect of the invention, the width of the groove of the groove profile corresponds to the full thickness of the groove-double tongue profile, preferably such that the groove-double tongue profile can be inserted in a form fitting manner in the groove of the groove profile. This way, a coupling of second profile with the third profile is possible, wherein the grooves and the tongues are contacting at the upper side and the bottom side of the panel.

In a preferred embodiment of the first aspect of the invention, the tongues and grooves of the first profile, the second profile and the third profile are configured such that the panel edge or edges provided with the first profile can be coupled onto the panel edge or panel edges provided with the second profile as well as onto the panel edge or panel edges provided with the third profile of another such panel; and such that the panel edge or edges provided with the second profile can be coupled onto the panel edge or panel edges provided with the third profile of another such panel.

A preferred panel is rectangular, oblong or square.

In a preferred embodiment of the first aspect of the invention, the panel is oblong and both short edges are provided with the same profile selected from the first profile, the second profile or the third profile.

In such embodiment, both short edges comprise the same profile selected from the first profile, the second profile or the third profile. It means that both short edges comprise or the first profile or the second profile or the third profile. It does not mean that the profiles at both short edges must be identical—which however is not excluded—but that the profiles at both short edges both fulfill the features of the first profile, or both fulfill the features of the second profile, or both fulfill the features of the third profile.

In a preferred embodiment of the first aspect of the invention, each of the first profile, the second profile and the third profile extend continuously and without interruption along the full length of the panel edge where they are provided.

This facilitates the production of the panels.

In a preferred embodiment of the first aspect of the invention, the first profile, the second profile and the third profile have a constant cross section along the full length of the panel edge where they are provided. This facilitates the production of the panels.

In a preferred embodiment of the first aspect of the invention, the continuous groove of the groove profile comprises a bottom lip, wherein the bottom lip extends beyond the closing plane provided closer to the surface of the panel than the location of the continuous groove, wherein the closing plane is provided for making contact with or for being located close to the closing plane of another such panel in coupled condition of the panel with the another such panel.

Such embodiment provides increased stability of installed panels.

In a preferred embodiment of the first aspect of the invention, none of the first profile, the second profile and the third profile are provided with mechanical locking parts that in coupled condition of any one of the edges of the panel to any edge of another such panel would result in a locking in the direction perpendicular to the coupled edges and parallel with the surface of the coupled panels.

Such panels have less complex coupling profiles and are therefore more easy to manufacture as less complex milling equipment is required. Furthermore, thinner panels can be made.

Although there is no mechanical locking in the direction perpendicular to the coupled edges and parallel with the surface of the coupled panels, there can be some frictional forces between contact surfaces of contacting tongues and grooves of the coupled edges.

In a preferred embodiment of the first aspect of the invention, each of the first edge, the second edge, the third edge and the fourth edge are provided closer to the panel surface than the first profile, the second profile and the third profile with a closing plane, wherein the closing planes are provided perpendicularly to the panel surface. In coupled condition of two panels the closing planes of the panel edges coupled to each other contact each other or are positioned close to each other.

It is the intention that closing planes of coupled panels contact each other. However, due to manufacturing tolerance it cannot be excluded that a small gap occurs between the closing planes of coupled panels.

In a preferred embodiment of the first aspect of the invention, the continuous groove of the second profile relates to a segmented groove, wherein the segmented groove comprises an upper section closest to the surface of the panel, a middle section and a bottom section, wherein the middle section extends more proximal into the panel than the upper section and the bottom section.

Such panels are easy to manufacture and provide a very stable locking in the direction perpendicular to the surface of the panels.

In a more preferred embodiment of the first aspect of the invention, the middle section comprises an upper lip and a bottom lip, wherein the upper section comprises an upper lip, wherein the upper section extends at its bottom over part of its depth into the middle section, wherein the bottom section comprises a bottom lip and extends at its upper side over part of its depth into the middle section.

Such panels are easy to manufacture and provide a very stable locking in the direction perpendicular to the surface of the panels.

In a preferred embodiment of the first aspect of the invention, the bottom section extends more distal into the panel than the upper section.

Such panels are easy to manufacture and provide a very stable locking in the direction perpendicular to the surface of the panels.

In a preferred embodiment of the first aspect of the invention, the panel comprises a decorative layer, wherein the decorative layer is a veneer layer—preferably a wood veneer layer—or wherein the decorative layer is a layer of wood, preferably wherein the layer of wood is thicker than a wood veneer layer.

In a preferred embodiment of the first aspect of the invention, the panel comprises a plurality of wood layers, preferably including a decorative wood layer; more preferably wherein the decorative wood layer comprises of consists of a wood veneer or comprises or consists of a layer of wood thicker than a wood veneer layer.

In a preferred embodiment of the first aspect of the invention, the panel comprises at least three layers of wood, wherein the layers of wood comprise a first layer of wood, a second layer of wood and a third layer of wood, wherein the second layer of wood is provided between the first layer of wood and the third layer of wood; and wherein the continuous tongue of the first profile is provided in the second layer of wood.

Such embodiments have the advantage that the wood layers can be selected for optimum performance of coupling of the edges.

In a preferred embodiment of the first aspect of the invention, the first edges comprises the third profile, the third edge comprises the second profile, the second edge and the fourth edge both comprise the first profile.

The second edge and the fourth edge comprise the first profile. It means that both edges comprise a profile that comprising the claimed features of the first profile. It does not mean that the profiles at these two edges must be identical—which however is not excluded—but that the profiles at both edges both fulfill the claimed features of the first profile.

Such embodiment allows an installation in herringbone pattern without requiring a modification of the panel edges.

In a preferred embodiment of the first aspect of the invention, the first edge comprises the first profile, the third edge comprises the second profile, the second edge and the fourth edge both comprise the third profile.

The second edge and the fourth edge comprise the third profile. It means that both edges comprise a profile that comprising the claimed features of the third profile. It does not mean that the profiles at these two edges must be identical—which however is not excluded—but that the profiles at both edges both fulfill the claimed features of the third profile.

Such embodiment allows an installation in herringbone pattern without requiring a modification of the panel edges.

In a preferred embodiment of the first aspect of the invention, the first edge comprises the first profile, the third edge comprises the third profile, and the second edge and the fourth edge both comprise the second profile.

The second edge and the fourth edge comprise the second profile. It means that both edges comprise a profile that comprising the claimed features of the second profile. It does not mean that the profiles at these two edges must be identical—which however is not excluded—but that the profiles at both edges both fulfill the claimed features of the second profile.

Such embodiment allows an installation in herringbone pattern without requiring a modification of the panel edges.

In a more preferred such embodiment, a bottom cheek of the groove of the groove profile of the second profile is removed at the second edge and at the fourth edge of the panel, such that the bottom section of the groove of the groove profile of the second profile ends at the vertical plane comprising the closing plane at the surface of the floor panel or ends more proximal than the vertical plane comprising the closing plane at the surface of the floor panel.

This way, the panels can be installed in linear patterns also, besides the installation in herringbone patterns. This enables installation in patterns combining panels installed parallel to each other and panels installed in a 90° angle.

With installation is linear pattern is meant that rectangular and oblong panels can be coupled at their short edges to each other.

The second aspect of the invention relates to a laying pattern comprising a plurality of panels as in any embodiment of the first aspect of the invention, wherein the panels are coupled to each other at a 90° angle, preferably in a herringbone configuration.

The third aspect of the invention relates to a laying pattern comprising a plurality of panels, wherein the panels are panels as in any embodiment of the first aspect of the invention wherein the first edge comprises the first profile, the third edge comprises the third profile, and the second edge and the fourth edge both comprise the second profile, wherein the second edge and the fourth edge comprise the second profile. It means that both edges comprise a profile that comprising the claimed features of the second profile. It does not mean that the profiles at these two edges must be identical—which however is not excluded—but that the profiles at both edges both fulfill the claimed features of the second profile. A bottom cheek of the groove of the groove profile is removed at the second edge and at the fourth edge of the panel, such that the bottom section of the groove of the groove profile ends at the vertical plane comprising the closing plane at the surface of the floor panel or ends more proximal than the vertical plane comprising the closing plane at the surface of the floor panel. In the laying pattern of the third aspect of the invention, the panels are installed in parallel rows, preferably wherein an insert is provided between two coupled edges that each comprise the second profile, wherein the insert is configured for realizing a locking of the coupled panels at these edges in the direction perpendicular to the panel surface.

The fourth aspect of the invention relates to a laying pattern comprising a combination of any embodiment of the laying pattern of the second aspect of the invention and any embodiment of the laying pattern of the third aspect of the invention.

The fifth aspect of the invention relates to a set of panels, wherein the set of panels comprises and preferably consists of panels as in any embodiment of the first aspect of the invention.

The sixth aspect of the invention relates to a panel, wherein the panel is rectangular, square or oblong, wherein the panel comprises a first edge and a third edge, wherein the first edge and the third edges are provided opposite to each other, wherein the panel comprises a second edge and a fourth edge wherein the second edge and the fourth edge are provided opposite to each other, wherein each of the first edge, the second edge, the third edge and the fourth edge comprise a profile selected from a first profile, a second profile and a third profile, wherein the first profile, the second profile and the third profile are configured such that a panel edge comprising the first profile can be coupled to the edge of another such panel wherein the edge of the another such panel comprises any one of the second profile or the third profile, wherein in the coupled condition a locking of the coupled edges is provided in the direction perpendicular to the coupled panels as well as in the direction perpendicular to the coupled edges and parallel with the surface of the coupled panels;

and such that a panel edge comprising the second profile can be coupled to the edge of another such panel wherein the edge of the another such panel comprises the third profile, wherein in the coupled condition a locking of the coupled edges is provided in the direction perpendicular to the coupled panels as well as in the direction perpendicular to the coupled edges and parallel with the surface of the coupled panels.

It is a benefit that only one type of panel is required for making installations in herringbone pattern, while a locking of the coupled panels is obtained in the direction perpendicular to the panel surface as well as in the direction perpendicular to the coupled edges and parallel with the panel surface.

According to the sixth aspect of the invention, two opposite edges comprise the same profile selected from the first profile, the second profile or the third profile. It means that two opposite edges comprise or the first profile or the second profile or the third profile. It does not mean that the profiles at these two opposite edges must be identical—which however is not excluded—but that the profiles at both opposite edge both fulfill the features of the first profile, or both fulfill the features of the second profile, or both fulfill the features of the third profile In a preferred embodiment of the sixth aspect of the invention, the first profile comprises a groove, wherein the groove is bordered by a lower lip and by an upper lip, wherein the lower lip extends distally to beyond the upper lip; wherein the lower lip comprises a locking element, preferably at its distal end, wherein the locking element is provided for realizing a locking in the direction perpendicular to the coupled edges and parallel with the panel surface when a panel edge comprising the first profile is coupled to the edge of another such panel when said edge of the another such panel comprises any one of the second profile or the third profile.

The upper lip comprises a locking surface—preferably wherein the locking surface is parallel to or inclined with respect to the surface of the panel—for establishing a locking in the direction perpendicular to the panel surface when a panel edge comprising the first profile is coupled to the edge of another such panel when said edge of the another such panel comprises the third profile.

The second profile comprises a tongue; wherein the tongue is configured for insertion in the groove of the first profile of an edge of another such panel, thereby establishing a locking in the direction perpendicular to the surface of the so coupled panels.

The tongue comprises a first recess, wherein the first recess is suited for cooperation with the locking element of the first profile of an edge of another such panel thereby establishing a locking of the so-coupled panels in the direction perpendicular to the coupled edges and parallel with the panel surface.

The tongue comprises a second recess, wherein the second recess is suited for cooperation with the locking element of the third profile of an edge of another such panel thereby establishing a locking of the so-coupled panels in the direction perpendicular to the coupled edges and parallel with the panel surface.

The second profile comprises closer to the panel surface than the location of the tongue, a locking surface—preferably wherein the locking surface is parallel to or inclined with respect to the surface of the panel—for establishing a locking in the direction perpendicular to the panel surface when a panel edge comprising the second profile is coupled to the edge of another such panel when said edge of the another such panel comprises the third profile.

The third profile comprises a first tongue and a second tongue; wherein the second tongue is provided closer to the panel surface than the first tongue; wherein a second groove is provided between the first tongue and the second tongue; wherein the first tongue comprises at its bottom a recess, wherein the recess is provided for establishing, in cooperation with the locking element of the lower lip of the first profile, a locking in the direction perpendicular to the coupled edges and parallel with the surface of the panel when a panel edge comprising the third profile is coupled onto the edge comprising the first profile of another such panel.

The second tongue comprises a locking surface for establishing a locking in the direction perpendicular to the surface of the panels in combination with the locking surface of the first profile or the locking surface of the second profile, when a panel edge comprising the third profile is coupled to an edge of another such panel comprising the first profile respectively the second profile.

The first tongue or the second tongue comprise a locking element, wherein the locking element is provided for establishing in combination with the second recess of the second profile a locking in the direction perpendicular to the coupled edges and parallel with the panel surface when a panel edge comprising the third profile is coupled to the edge comprising the second profile of another such panel.

In a preferred embodiment of the sixth aspect of the invention, the locking element of the lower lip of the first profile is directed upwards.

In a preferred embodiment of the sixth aspect of the invention, the first recess and the second recess are provided at different sides of the tongue, preferably wherein the first recess is provided at the bottom of the tongue.

Such embodiments ensure efficient locking and facilitate the milling of the profiles.

In a preferred embodiment of the sixth aspect of the invention, the first recess and the second recess are provided at the same side of the tongue, preferably wherein the first recess and the second recess are provided at the bottom of the tongue.

Such embodiments ensure efficient locking and facilitate the milling of the profiles.

In a preferred embodiment of the sixth aspect of the invention, the locking surface of the upper lip of the first profile is provided at the upper surface of an additional groove closer to the panel surface than the groove of the first profile.

Such embodiments ensure that a sufficiently large locking surface can be provided for efficient locking of coupled panels in the direction perpendicular to the panel surface.

In a preferred embodiment of the sixth aspect of the invention, the locking surface of the upper lip of the first profile is provided as an inclined surface at the distal edge of the upper lip.

In a preferred embodiment of the sixth aspect of the invention, the locking surface of the second profile is provided at the upper side of an undercut in the second profile.

Such embodiments allow to provide a locking surface with a sufficiently large surface area for efficient locking of coupled panels in the direction perpendicular to the surface of the panels.

In a preferred embodiment of the sixth aspect of the invention, an upper surface of the second tongue provides the locking surface of the third profile.

This is an efficient way to provide the locking in the direction perpendicular to the surface of the panel, and facilitates the milling operation of the third profile.

In a preferred embodiment of the sixth aspect of the invention, the locking surface of the second tongue is provided by a separate insert inserted in the second tongue. The insert is configured such that the displacement of the locking surface by a displacement or—preferably elastic—deformation of at least part of the insert during the coupling of the panel edges provides for the locking in the direction perpendicular to the surface of the panel. Such embodiments provide an efficient way for realizing the vertical locking, especially for panels comprising layers of wood.

In a preferred embodiment of the sixth aspect of the invention, in coupled condition of an edge comprising the first profile to an edge comprising the second profile of another such panel, a gap is provided between the upper surface of the locking element of the first profile and the edge of the another panel.

Such embodiments allow that milling tolerances can be reduced while still obtaining a good locking of the coupled panels.

In a preferred embodiment of the sixth aspect of the invention, in coupled condition of an edge comprising the first profile to an edge comprising the third profile of another such panel, a gap is provided between the upper surface of the locking element of the first profile and the edge of the another panel.

Such embodiments allow that milling tolerances can be reduced while still obtaining a good locking of the coupled panels.

In a preferred embodiment of the sixth aspect of the invention, in coupled condition of an edge comprising the first profile to an edge comprising the second profile of another such panel, the lower lip of the first profile contacts the second profile of the edge of the another such panel in two distinct zones, wherein a gap is provided between said two distinct zones.

Such embodiments allow that milling tolerances can be reduced while still obtaining a good locking of the coupled panels.

In a preferred embodiment of the sixth aspect of the invention, in coupled condition of an edge comprising the first profile to an edge comprising the third profile of another such panel, the lower lip of the first profile contacts the bottom of the first tongue of the second profile of the edge of the another such panel in two distinct zones, wherein a gap is provided between said two distinct zones.

Such embodiments allow that milling tolerances can be reduced while still obtaining a good locking of the coupled panels.

In a preferred embodiment of the sixth aspect of the invention, the first profile, the second profile and the third profile extend continuously and without interruption along the edge(s) where they are provided.

Such embodiments facilitate the milling of the profiles at the panel edges.

In a preferred embodiment of the sixth aspect of the invention, the first profile, the second profile and the third profile have a constant cross section perpendicularly to the edge where they are provided, over the full length of the edge where they are provided.

Such embodiments facilitate the milling of the profiles at the panel edges.

In a preferred embodiment of the sixth aspect of the invention, the first profile, the second profile and the third profile extend along the full length of the panel edge(s) where they are provided.

Such embodiments facilitate the milling of the profiles at the panel edges.

In a preferred embodiment of the sixth aspect of the invention, the panel is oblong and both short edges are provided with the same profile, preferably wherein both short edges are provided with the second profile.

In a preferred embodiment of the sixth aspect of the invention, each of the first edge, the second edge, the third edge and the fourth edge are provided closer to the panel surface than the first profile, the second profile and the third profile with a closing plane, wherein the closing planes are provided perpendicularly to the panel surface, and wherein in coupled condition of two panels the closing planes of the panel edges coupled to each other contact each other or are positioned closely to each other.

It is the intention that closing planes of coupled panels contact each other. However, due to manufacturing tolerance it cannot be excluded that a small gap occurs between the closing planes of coupled panels.

In a preferred embodiment of the sixth aspect of the invention, the panel comprises a decorative layer, wherein the decorative layer is a veneer layer—preferably a wood veneer layer—or wherein the decorative layer is a layer of wood, preferably wherein the layer of wood is thicker than a wood veneer layer.

In a preferred embodiment of the sixth aspect of the invention, the panel comprises a plurality of wood layers, preferably including a decorative wood layer; more preferably wherein the decorative wood layer comprises of consists of a wood veneer or comprises or consists of a layer of wood thicker than a wood veneer layer.

In a preferred embodiment of the sixth aspect of the invention, the panel comprises at least three layers of wood, wherein the layers of wood comprise a first layer of wood, a second layer of wood and a third layer of wood, wherein the second layer of wood is provided between the first layer of wood and the third layer of wood; and wherein the tongue of the second profile is provided in the second layer of wood.

This way, the layers of wood can be selected taking the required properties into account, including to obtain optimum performance of the continuous tongue of the first profile.

In a preferred embodiment of the sixth aspect of the invention, two opposite panel edges each comprise the first profile, the second profile or the third profile.

More preferably, the panel is oblong and the two opposite panel edges comprising each the first profile, the second profile or the third profile are the short edges.

In a preferred embodiment of the sixth aspect of the invention, the two panel edges that both comprise the same profile selected from the first profile, the second profile or the third profile, comprise profiles that have the same cross section perpendicular to the panel edge where the profiles are provided.

In a preferred embodiment of the sixth aspect of the invention, the two panel edges that both comprise the same profile selected from the first profile, the second profile or the third profile, comprise profiles selected from the first profile or the second profile or the third profile that differ in cross section perpendicular to the panel edge where the profiles are provided.

It is meant that the two panel edges comprise both a profile—however with differences between the profiles—that comprises the features of the first profile, or that comprises the features of the second profile, or that comprises the features of the third profile.

It is a benefit of such embodiment that the production process of the panel edges can be optimized.

In a more preferred such embodiment, two panel edges—preferably opposite panel edges and more preferably the short panel edges—both comprise the third profile, wherein both of these panel edges comprise a configuration of the third profile that differ in cross section perpendicular to the panel edge where the profiles are provided.

More preferably, at one of these two panel edges comprising a third profile an upper surface of the second tongue provides the locking surface of the third profile; and wherein at the other one of these two panel edges comprising a third profile the locking surface of the second tongue is provided by a separate insert inserted in the second tongue, wherein the insert is configured such that the displacement of the locking surface by a displacement or—preferably elastic—deformation of at least part of the insert during the coupling of the panel edges provides for said locking in the direction perpendicular to the surface of the panel.

It is a particular benefit of such embodiment that excellent locking is obtained, especially at edges comprising the third profile comprising an insert. It is a further benefit that existing production lines can be used, as it is known in the art to position an insert in one of the four panel edges of rectangular panels. It is general practice that opposing edges are milled in one and the same milling operation. Companies having installed such equipment can use it for positioning the insert in this preferred embodiment. No additional investment is required in additional equipment for positioning an insert in the opposing edges, additional investment which would be required if both opposite edges would be provided with an insert. Therefore, such embodiments are especially interesting because of their ease of manufacturing.

The seventh aspect of the invention relates to a laying pattern comprising a plurality of panels as in any embodiment of the sixth aspect of the invention, wherein the panels are coupled to each other under a 90° angle, preferably in a herringbone configuration.

The eighth aspect of the invention relates to a set of panels, wherein the set of panels comprises and preferably consists of panels as in any embodiment of the sixth aspect of the invention.

The ninth aspect of the invention relates to a panel, wherein the panel is rectangular, wherein the panel comprises a first edge, a second edge, a third edge and a fourth edge, wherein the first edge is provided with a first coupling profile, wherein the second edge is provided with a second coupling profile, wherein the third edge is provided with a third coupling profile, and wherein the fourth edge is provided with a fourth coupling profile.

The first coupling profile, the second coupling profile, the third coupling profile and the fourth coupling profile are configured such that the panel can be coupled at its first edge to anyone one of the first edge, the second edge or the third edge of another such panel; and such that the panel can be coupled at its second edge to anyone of the third edge or the fourth edge of another such panel, and such that the panel can be coupled at its third edge to the fourth edge of another such panel.

The panels according to the ninth aspect of the invention have the benefit that they can be installed in 90° angle configurations of the panels—e.g. in herringbone laying patterns—as well as linearly in rows, and in combinations of such laying patterns. The panels can be manufactured in an easy way and with high productivity.

In a preferred embodiment of the ninth aspect of the invention, the first coupling profile, the second coupling profile, the third coupling profile and the fourth coupling profile extend continuously along the edge where they are provided.

Such panels can be manufactured in an easy way, without expensive milling machines.

In a preferred embodiment of the ninth aspect of the invention, the first coupling profile, the second coupling profile, the third coupling profile and the fourth coupling profile extend along the full length of the edge where they are provided.

Such panels can be manufactured in an easy way, without expensive milling machines.

In a preferred embodiment of the ninth aspect of the invention, the first coupling profile, the second coupling profile, the third coupling profile and the fourth coupling profile each have along the length of the edge where they are provided a constant cross section perpendicular to the edge where they are provided.

Such panels can be manufactured in an easy way, without expensive milling machines.

In a preferred embodiment of the ninth aspect of the invention, in each of said coupled configurations of two such panels a locking is provided in the direction perpendicular to the surface of the coupled panels.

In a preferred embodiment of the ninth aspect of the invention, each of the first edge, the second edge, the third edge and the fourth edge comprises a closing plane, wherein the closing planes are provided substantially perpendicular to the surface of the panel, wherein the closing planes are provided for approaching and preferably for contacting the closing plane of any one of the four edges of another such plane.

In a preferred embodiment of the ninth aspect of the invention, the panel comprises a decorative layer, wherein the decorative layer is a veneer layer—preferably a wood veneer layer—or wherein the decorative layer is a layer of wood, preferably wherein the layer of wood is thicker than a wood veneer layer.

In a preferred embodiment of the ninth aspect of the invention, the panel comprises a plurality of wood layers, preferably including a decorative wood layer; more preferably wherein the decorative wood layer comprises of consists of a wood veneer or comprises or consists of a layer of wood thicker than a wood veneer layer.

In a preferred embodiment of the ninth aspect of the invention, the first coupling profile comprises a first groove at a first distance from the panel surface, a second groove at a second distance from the panel surface and a third groove at a third distance from the panel surface. The second coupling profile comprises a first tongue. The third coupling profile comprises a second tongue, a fourth groove and a fifth groove. The fourth coupling profile comprises a third tongue, a sixth groove and a seventh groove.

The first groove is configured for receiving the first tongue of another such panel, wherein a locking is provided in the direction perpendicular to the panel surface. The second groove is configured for receiving the second tongue of another such panel, wherein a locking is provided in the direction perpendicular to the panel surface. The third groove is configured for receiving the third tongue of another such panel, wherein a locking is provided in the direction perpendicular to the panel surface. The fourth groove is configured for receiving the first tongue of another such panel, wherein a locking is provided in the direction perpendicular to the panel surface. The fifth groove is configured for receiving the third tongue of another such panel, wherein a locking is provided in the direction perpendicular to the panel surface. The sixth groove is configured for receiving the first tongue of another such panel, wherein a locking is provided in the direction perpendicular to the panel surface. The seventh groove is configured for receiving the second tongue of another such panel, wherein a locking is provided in the direction perpendicular to the panel surface.

In a preferred embodiment of the ninth aspect of the invention, the third distance is smaller than the second distance; and the second distance is smaller than the first distance.

In a preferred embodiment of the ninth aspect of the invention, each of the first edge, the second edge, the third edge and the fourth edge comprise a closing plane, wherein the closing planes are provided substantially perpendicular to the surface of the panel, wherein the closing planes are provided for approaching and preferably for contacting the closing plane of one of the four edges of another such plane. The first coupling profile comprises a bottom lip extending distally to beyond the closing plane of the first edge, wherein the bottom lip is provided with an upper surface wherein the second coupling profile, the third coupling profile and the fourth coupling profile and the upper surface are configured for establishing a locking—preferably with contact—of the first edge of the panel in the direction perpendicular to the panel surface when the first edge is coupled respectively to the second edge, the third edge or the fourth edge of another such panel.

In a preferred embodiment of the ninth aspect of the invention, each of the first edge, the second edge, the third edge and the fourth edge comprise a closing plane, wherein the closing planes are provided substantially perpendicular to the surface of the panel, wherein the closing planes are provided for approaching and preferably for contacting the closing plane of one of the four edges of another such plane. The second coupling profile comprises proximally from the closing plane of the second edge an upper surface. The third coupling profile and said upper surface are configured for establishing a locking—preferably with contact—of the second edge of the panel in the direction perpendicular to the panel surface when the second edge is coupled to the third edge of another such panel.

In a preferred embodiment of the ninth aspect of the invention, each of the first edge, the second edge, the third edge and the fourth edge comprise a closing plane, wherein the closing planes are provided substantially perpendicular to the surface of the panel, wherein the closing planes are provided for approaching and preferably for contacting the closing plane of one of the four edges of another such plane. The second locking profile comprises a contact surface, preferably substantially parallel with the panel surface, wherein said contact surface is provided proximally from the closing plane of the second locking profile. The second coupling profile and the fourth coupling profile are configured for establishing a locking in the direction perpendicular to the panel surface—preferably with contact—of the panel edge comprising the second coupling profile when coupled to the edge comprising the fourth coupling profile of another such panel by means of the upper surface of the third tongue and the contact surface of the second locking profile.

In a preferred embodiment of the ninth aspect of the invention, the panel is rectangular and oblong, and the first coupling profile and the fourth coupling profile are provided at the long edges of the panel; and the second coupling profile and the third coupling profile are provided at the short edges of the panel.

Such embodiments are easy to manufacture and provide easy of installation with excellent locking in the direction perpendicular to the panel surface.

In a preferred embodiment of the ninth aspect of the invention, in none of the coupled configurations of two such panels, a mechanical locking is provided in the direction perpendicular to the coupled edges and parallel with the surface of the coupled panels.

In a preferred embodiment of the ninth aspect of the invention, each of the first coupling profile, the second coupling profile, the third coupling profile and the fourth coupling profile are configured such that they can be milled exclusively by milling with milling tools having an axis perpendicular to the panel surface.

It is a benefit of such embodiment that no expensive machinery is required to produce the coupling profiles of the panels.

The tenth aspect of the invention relates to a laying pattern, wherein the laying pattern comprises a plurality of panels as in any embodiment of the ninth aspect of the invention, wherein at least part of the panels is installed in a 90° angle configuration and/or wherein at least part of the panels are installed in linear configuration.

The panels of the ninth aspect of the invention allow to install the panels in complex configurations.

The panels according to the different aspects of the invention can be made in all kinds of materials, e.g. in laminate, in parquet, in polyvinylchloride (e.g. Luxury Vinyl Tiles, Solid Plastic Composite or Water Proof Composites) and made in different thicknesses.

It is possible to make all kind of installation patterns with the panels according to the invention, in particular installation patterns wherein the panels are installed with a 90° angle in between them, e.g. herringbone configurations.

The profiles of the panels according to the invention can be made with simple machinery and with high speeds. The installation of the panels in complex patterns is facilitated—and therefore faster—as only one single type of panels is required.

BRIEF DESCRIPTION OF THE DRAWINGS

With the intention of better showing the characteristics of the invention, hereafter, as an example without any limitative character, several preferred embodiments are described, with reference to the accompanying drawings, wherein.

DETAILED DESCRIPTION OF VARIOUS EMBODIMENTS

FIGS. 1-17 illustrate the first aspect of the invention, and laying patterns realized with panels according to the first aspect of the invention.

The objective of the first aspect of the invention is to provide panels that can be installed in different laying patterns, including herringbone, wherein only one type of panels are required, and without the need to have provide additional inserts such as separate tongues for making the herringbone installation. Panels according to the first aspect of the invention are illustrated in FIGS. 1-17, in which three different panel embodiments A, B and C are illustrated.

The panels of the first aspect of the invention are rectangular, and thus have a first pair of opposing edges and a second pair of opposing edges (the first edge and the third edge are parallel to each other; and the second edge and the fourth edge are parallel to each other). The rectangular panel can be square or oblong.

Each of the panels A, B, C comprise a closing plane 101, which extends from the upper panel surface O perpendicularly in the direction of the panel bottom U up to the start of the profile 1, 2, 3.

The closing plane 101 is provided for making contact with or for being located close to the closing plane 101 of another such panel in coupled condition of the panel with the another such panel. The objective of the closing plane 101 is to provide a closed visible joint between coupled panels.

Figure 1:
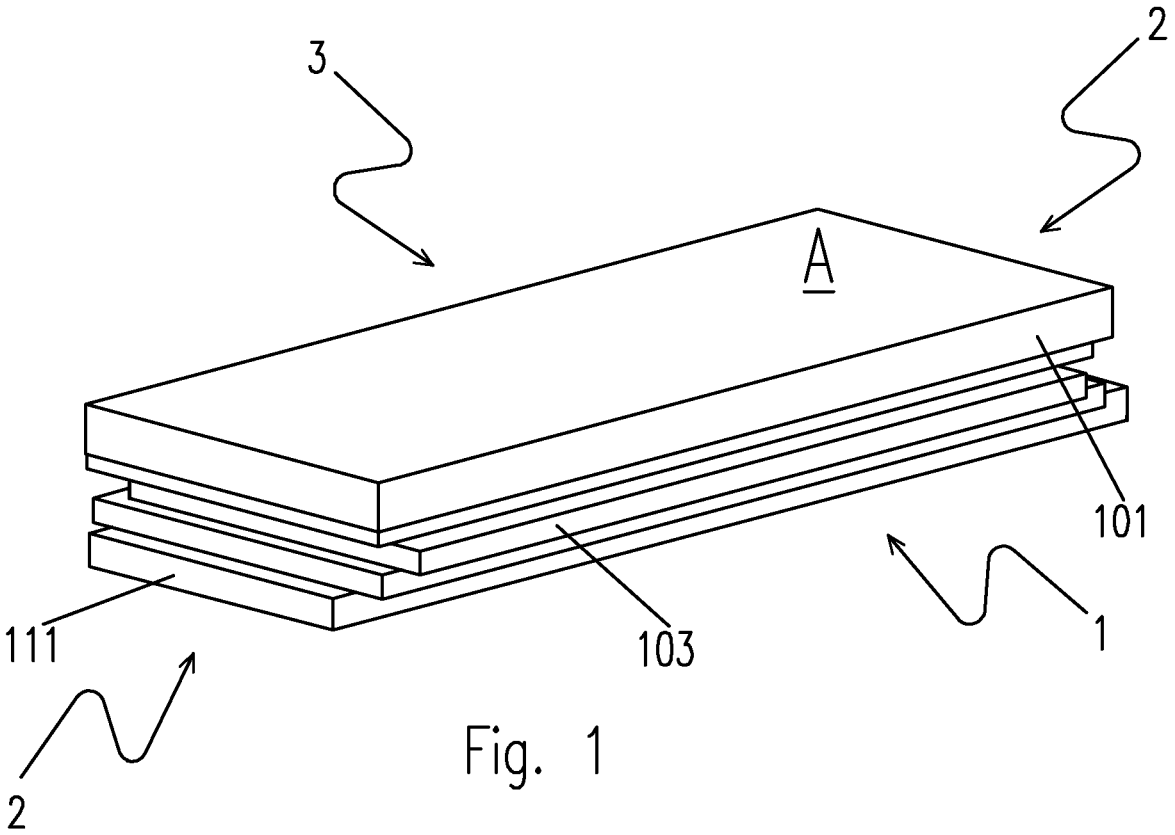
FIG. 1 shows a panel A according to an embodiment of the invention.
Figure 2:
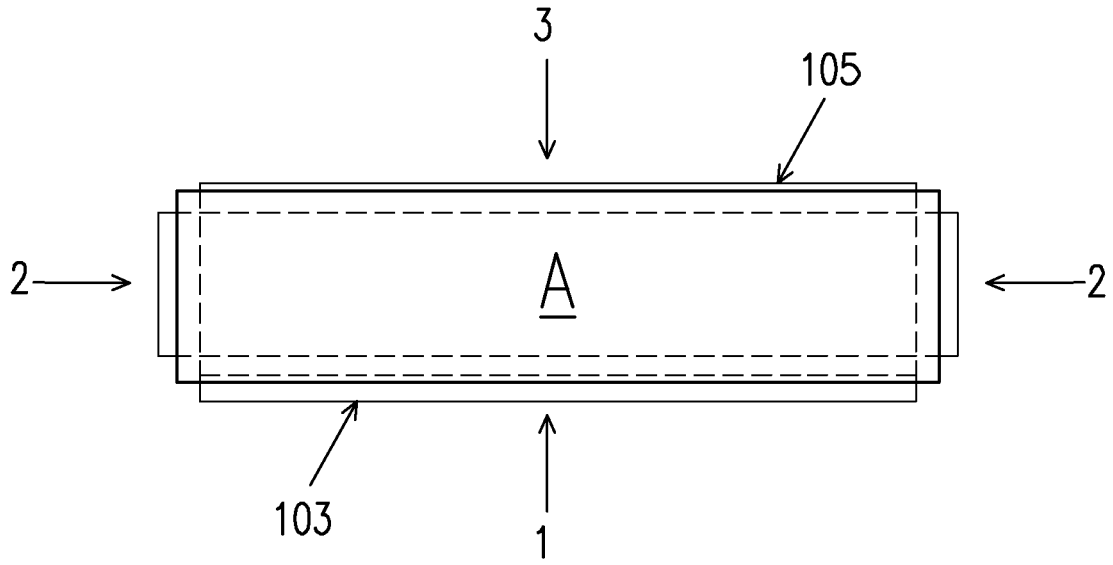
FIG. 2 shows a top view of panel A of FIG. 1.

The basic principle as well as the three profiles (the first profile, the second profile and the third profile); wherein the first profile comprises or consists of a groove-tongue profile 1, wherein the second profile comprises or consists of a groove profile 2 comprising a continuous groove 109, and wherein the third profile comprises or consists of a groove-double tongue profile 3, are first described for an exemplary panel A. FIG. 1 shows a panel A according to an embodiment of the invention. FIG. 2 shows a top view of panel A of FIG. 1. Both figures show that in this example both short edges (edges 2 and 4) of the rectangular panel comprise the same profile, more particularly the groove profile 2. The two other edges (edges 1 and 3) comprise respectively a groove-tongue profile 1 and a groove-double tongue profile 3.

Figure 3:
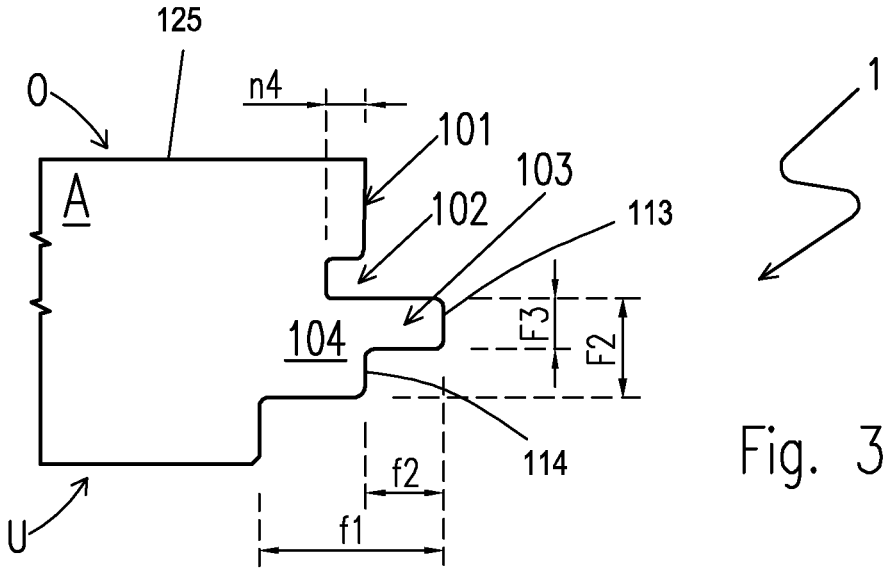
FIG. 3 shows a cross section of a groove-tongue profile 1 according to an embodiment of the invention.
Figure 4:
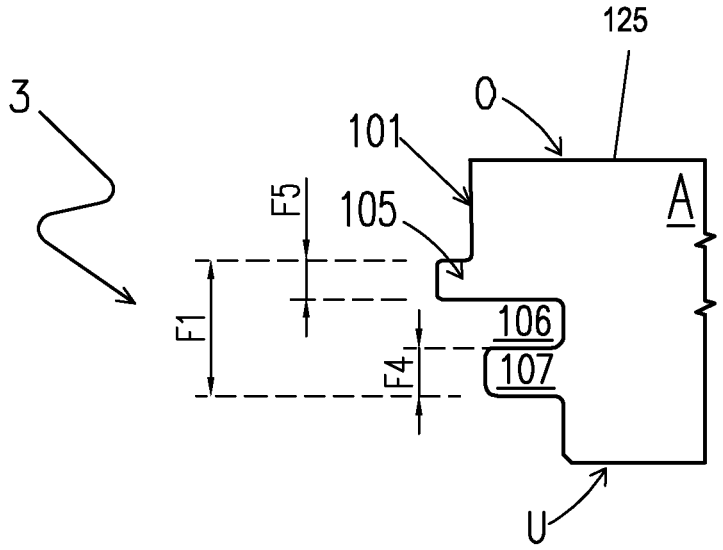
FIG. 4 shows a cross section of a groove-double tongue profile 3 according to an embodiment of the invention.
Figure 5:
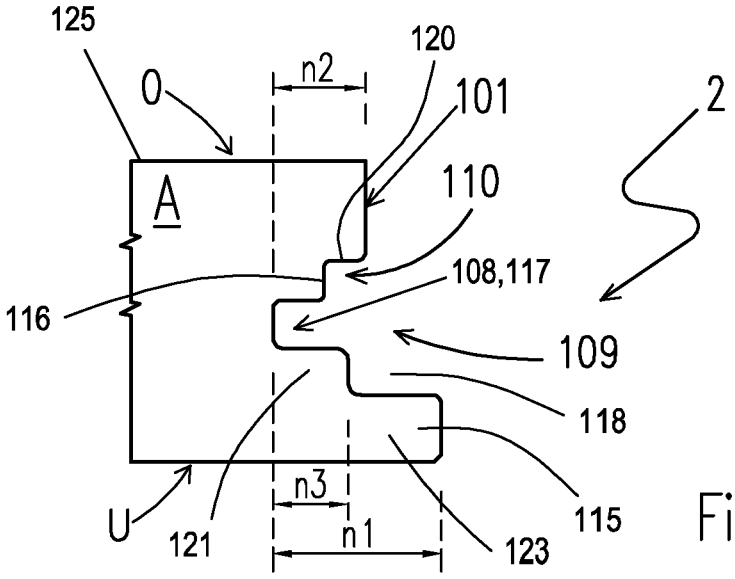
FIG. 5 shows a cross section of a groove profile 2 according to an embodiment of the invention.

Examples of these three profiles are described in FIGS. 3-5. FIG. 3 shows a cross section of a groove-tongue profile 1 according to an embodiment of the invention. FIG. 4 shows a cross section of a groove-double tongue profile 3 according to an embodiment of the invention. FIG. 5 shows a cross section of a groove profile 2 according to an embodiment of the invention.

Figure 6:
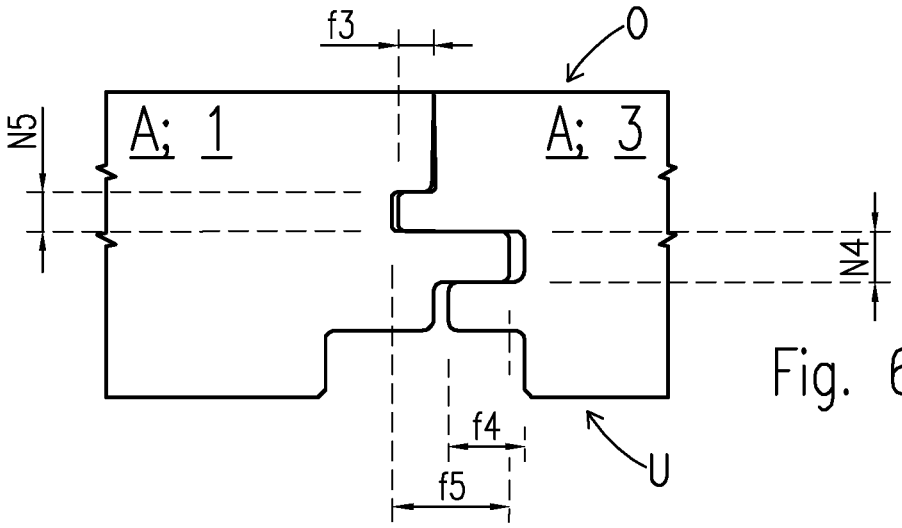
FIG. 6 shows a cross section of a coupling of a groove-tongue profile 1 with a groove-double tongue profile 3 according to an embodiment of the invention.

FIG. 3 shows a panel edge comprising a first profile. The panel edge has a closing plane 101. The first profile comprises a groove-tongue profile 1. The tongue-groove profile comprises a continuous groove 102 which follows the closing plane 101. The continuous groove 102 has a groove width N5 and a groove depth n4. The groove 102 is provided for receiving the upper tongue 105 of the groove-double tongue profile 3, when the first profile and the third profile are coupled to each other, as is shown in FIG. 6.

Figure 8:
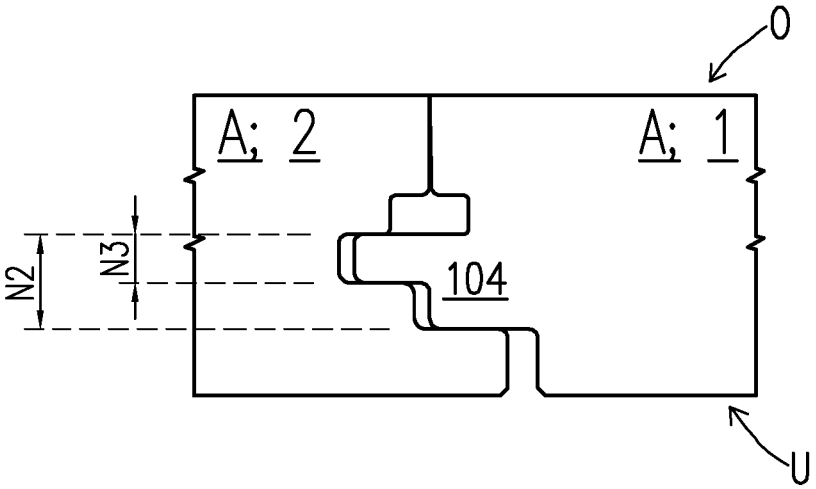
FIG. 8 shows a cross section of a coupling of a groove profile 2 with a groove-tongue profile 1 according to an embodiment of the invention.

Following the continuous groove 102, the groove-tongue profile 101 comprises a continuous tongue 104 having a total thickness F2 and a total length f2. The nose 103 of the tongue 104 which extends to beyond the vertical plane comprising the closing plane 101 has a thickness F3 and a length f2. The upper side of the tongue nose 103 (from the back end of the groove 102 up to the front end of the tongue nose 103) has a tongue length f5. The tongue nose 103 is provided for fitting in the groove 160 of the groove-double tongue profile 3, when the first profile and the third profile are coupled to each other, as is shown in FIG. 6. At its bottom, the thickness of the continues tongue 104 increase from F3 to F2, in order to be able to receive the bottom tongue 107 of the groove-double tongue profile 3, when the first profile is coupled to the third profile, as is shown in FIG. 6. The bottom of the continuous tongue 104 has the function to receive a bottom cheek 111 of a groove of the groove profile 2, when the first profile is coupled to a second profile as is shown in FIG. 8.

In the example shown, the continuous tongue 104 of the groove-tongue profile 1 comprises two different end faces 113, 114. The two different end faces 113, 114 are provided at different distances from the panel edge where the first profile is provided. The two end face comprise an end surface substantially perpendicular to or perpendicular to the panel surface.

Figure 7:
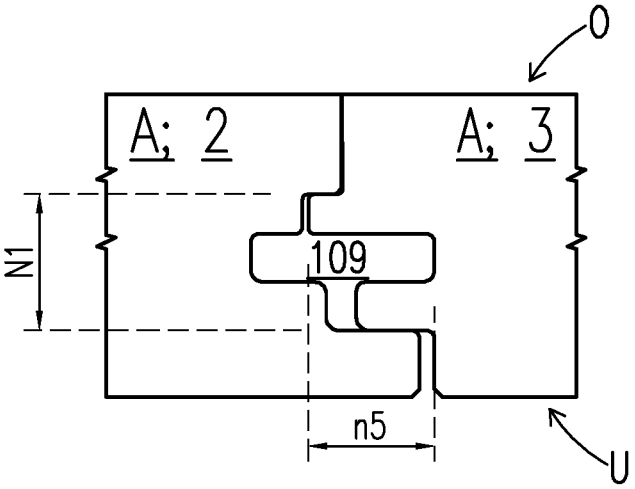
FIG. 7 shows a cross section of a coupling of a groove profile 2 with a groove-double tongue profile 3 according to an embodiment of the invention.

FIG. 4 shows a panel edge comprising a second profile. The panel edge has a closing plane 101 followed by the groove-double tongue profile 3. The groove-double tongue profile comprises a continuous groove 106, having a groove width N4. The groove-double tongue profile 3 comprises a continuous double tongue 105, 107, having different tongue thicknesses F1, F4, F5 and different tongue lengths f3, f4. The double tongue comprises an upper tongue 105 and a lower tongue 107. The upper tongue has thickness F5 and a length f3, it is meant that the upper tongue extends from the closing plane over a distance f3. A continuous groove 106 having a width N4 is provided between the upper tongue 105 and the lower tongue 107. The continuous groove 106 is configured such that it can receive the tongue 103 of the groove-tongue profile 1, as is shown in FIG. 6. The lower tongue 107 has a thickness F4 and a length f4. The total thickness F1 of the groove-double tongue 3 is provided by the combination of the thickness F4 and F5 of the upper tongue and the lower tongue and the thickness N4 of the groove 106, which at least is larger than the thickness F3 of the tongue 103 of the first profile. The second profile can be coupled to the third profile, as is shown in FIG. 7. In the example shown, the groove-double tongue 3 functions as a single tongue with tongue thickness F1. It is meant that the upper side of the upper tongue 105 and the bottom side of the lower tongue 107 are to be considered the upper side and the lower side of a single tongue which is inserted in the continuous groove 109 of the groove profile 2 of the second profile, and coupled therewith.

FIG. 5 shows a panel edge comprising a second profile. The panel edge has a closing plane 101. Following to the closing plane, a groove profile is provided comprising a continuous groove 109 having different groove widths N1, N2, N3 and different groove depths n1, n2, n3. The continuous groove 109 follows the closing plane 101. The groove 109 has a tot depth n1 and a total width N1. The continuous groove 109 is a segmented groove. The segmented groove comprises an upper section 110, 116 closest to the surface of the panel, a middle section 108, 117 and a bottom section 118. The middle section extends more proximal into the panel than the upper section and the bottom section.

The middle section 117 comprises an upper lip 120 and a bottom lip 121 and the upper section 116 comprises an upper lip 122. The upper section 116 extends at its bottom over part of its depth into the middle section 117. The bottom section 118 comprises a bottom lip 123, 115 and extends at its upper side over part of its depth into the middle section 117. The bottom section 118 extends more distal into the panel than the upper section 116.

The upper section 116, 110 is provided for locking the upper tongue 105 of the groove-double tongue 3, when the second profile is coupled to third profile as shown in FIG. 7.

The middle section 117 is an inner groove 108, the upper side of which end in the groove width n2 and which bottom side ends in the groove width n3. The middle section has a groove width N3, configured for receiving the tongue nose 103 of the groove-tongue profile, when the second profile and the first profile are coupled to each other, as is shown in FIG. 8. The bottom section has a groove width N2-N3. The bottom section borders a bottom cheek 111. The horizontal distance between the between the most proximal end of the middle section and the distal end of the bottom cheek 111 equals n1. This distance is larger than the groove depth n2 between the most proximal end of the middle section and the closing plane 101. The combined width of the middle section and the bottom section is N2. the bottom cheek 111 functions to support the bottom of tongue 107 of the third profile, but also, to be pushed under the bottom of tongue 104 of the first profile, such that a locking is provided in the direction perpendicular to the panel surface.

Each of the first profile, the second profile and the third profile illustrated in FIGS. 3, 4 and 5 respectively are configured such that they can be realized by milling operations with milling axis perpendicular to the surface of the panel.

In the examples shown, each of the first profile, the second profile and the third profile extend continuously and without interruption along the full length of the panel edge where they are provided; and have a constant cross section along the full length of the panel edge where they are provided.

As is clear from the description of the examples shown in FIGS. 3-5, none of the first profile, the second profile and the third profile are provided with mechanical locking parts that in coupled condition of any one of the edges of the panel to any edge of another such panel would result in a locking in the direction perpendicular to the coupled edges and parallel with the surface of the coupled panels.

From the description provided for the profiles of FIGS. 3-5, it will be clear that the groove widths N3, N4, N5 of the grooves 102, 106, 108 of the groove-tongue profile 1, the groove-double tongue profile 3 and the groove profile 2 are configured; and that the corresponding tongues 103, 105, 107 of a to be coupled groove-tongue profile 1 and/or a to be coupled groove-double tongue profile 3 are configured such that the panels can be coupled at the upper side U and/or at the bottom side U of the panel in a form fitting manner.

From the description provided for the profiles of FIGS. 3-5, it will be clear that the width N1 of the groove 109 of the groove profile 2 corresponds to the full thickness F1 of the groove-double tongue profile 3, such that the groove-double tongue profile 3 can be inserted in a form fitting manner in the groove 109 of the groove profile 2.

From the description provided for the profiles of FIGS. 3-5, it will be clear that the tongues 104, 105, 107 and grooves 102, 109, 106 of the first profile, the second profile and the third profile are configured such that the panel edge or edges provided with the first profile can be coupled onto the panel edge or panel edges provided with the second profile as well as onto the panel edge or panel edges provided with the third profile of another such panel; and such that the panel edge or edges provided with the second profile can be coupled onto the panel edge or panel edges provided with the third profile of another such panel.

The panel comprises a decorative layer 125, e.g. a veneer layer—preferably a wood veneer layer—or a layer of wood, preferably wherein the layer of wood is thicker than a wood veneer layer.

As already indicated, FIG. 6 shows a cross section of a coupling of a groove-tongue profile 1 with a groove-double tongue profile 3 according to an embodiment of the invention. FIG. 7 shows a cross section of a coupling of a groove profile 2 with a groove-double tongue profile 3 according to an embodiment of the invention. FIG. 8 shows a cross section of a coupling of a groove profile 2 with a groove-tongue profile 1 according to an embodiment of the invention.

Figure 9:
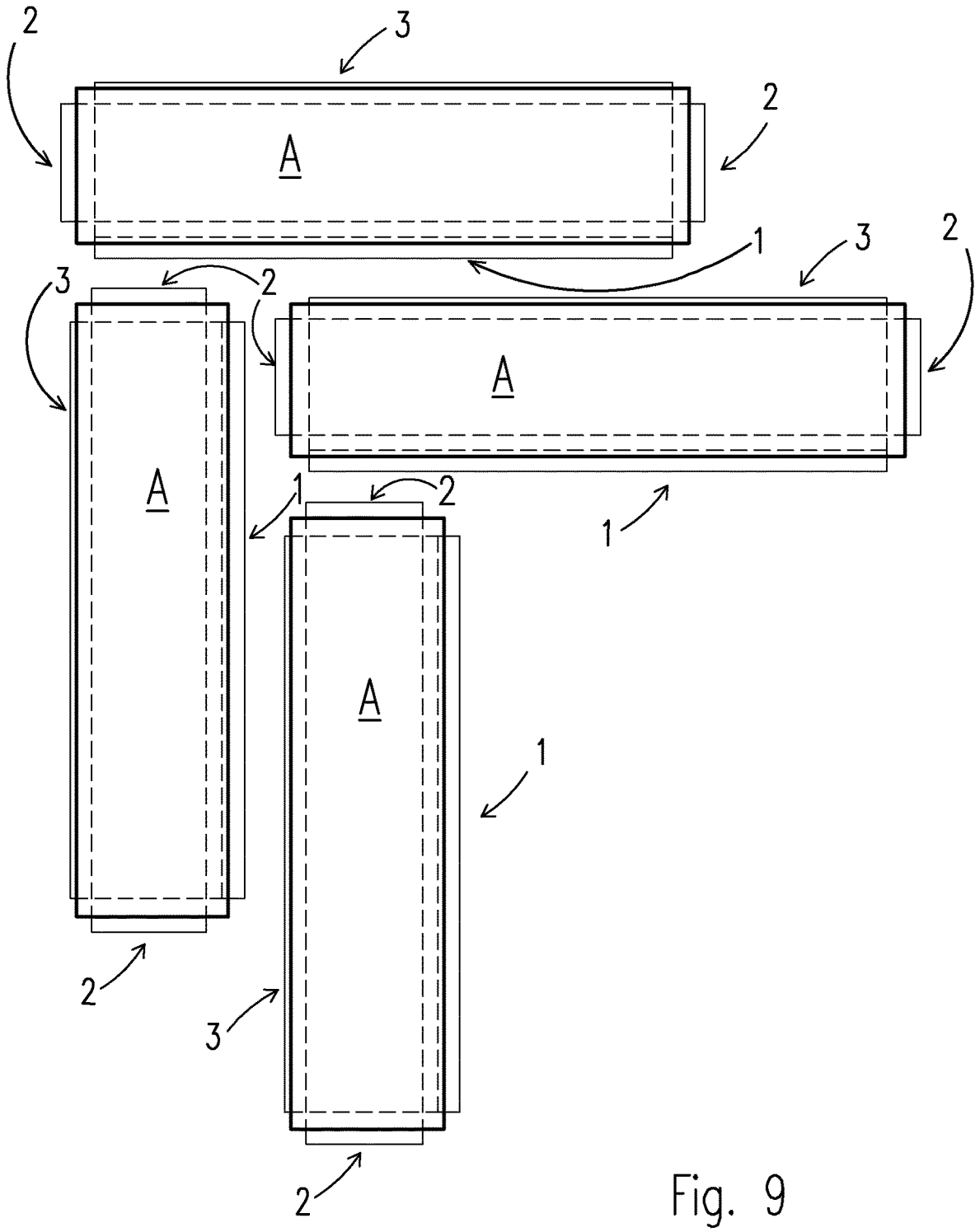
FIG. 9 shows a top view of a plurality of panels A according to the invention, installed such that a 90° angle is established between panels.

FIG. 9 shows a top view of a plurality of panels A according to the invention, installed such that a 90° angle is established between panels. FIG. 9 shows a herringbone configuration of panels. No additional parts, such as additional tongues, nor additional post forming of panel edges is required for laying the panels A of FIGS. 1 and 2 (and provided with the profiles as shown in FIGS. 3-5) in herringbone configuration.

By using the first profile, the second profile and the third profile on a panel A, B, C; a herringbone installation only using panels A, or only using panels B or only using panels C is possible. It means that it is not required to have two different panels types (left hand side and right hand side panels) available, only one type is sufficient.

Figure 10:
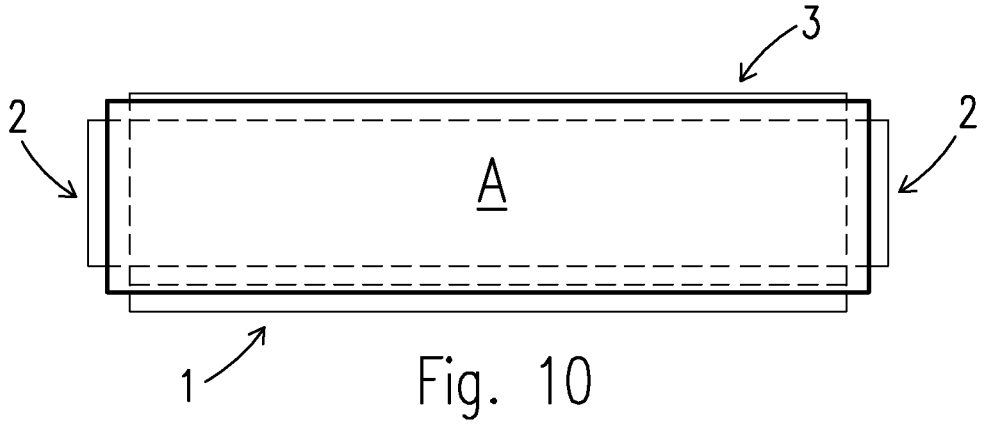
FIG. 10 shows a top view of panel A of FIG. 1.
Figure 11:
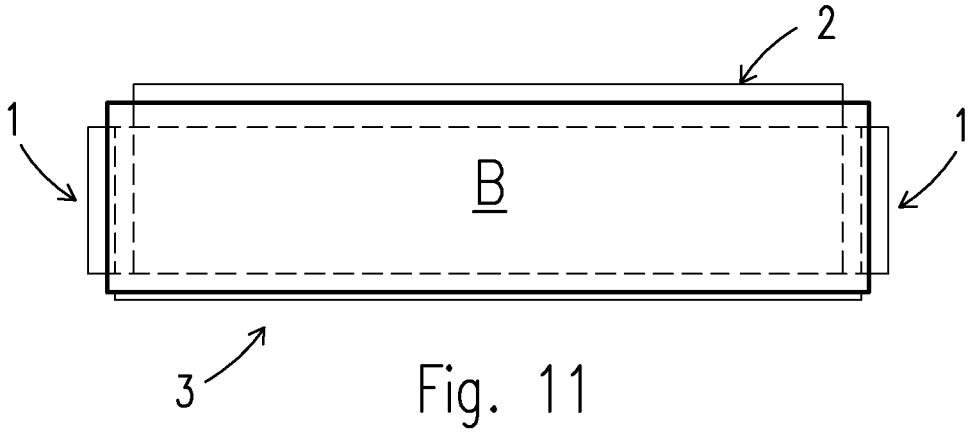
FIG. 11 shows a top view of a panel B according to an embodiment of the invention.
Figure 12:
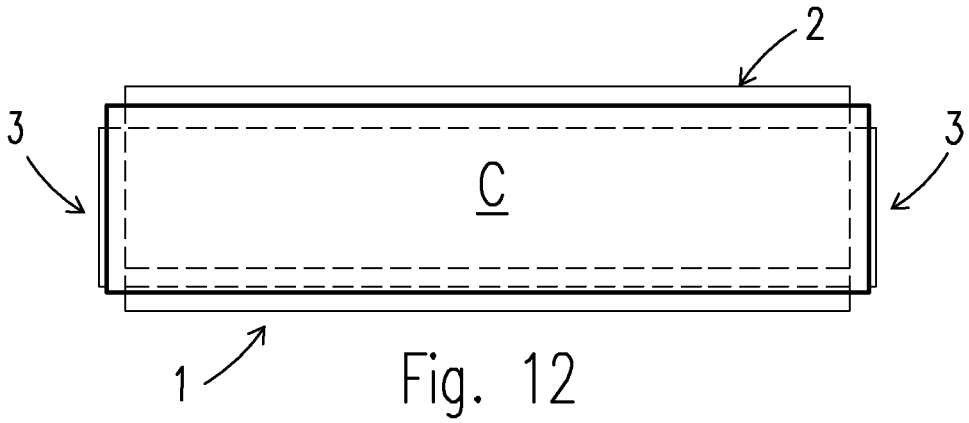
FIG. 12 shows a top view of a panel C according to an embodiment of the invention.

FIGS. 10-12 show three embodiments of panels A, B and C according to the first aspect of the invention. The embodiments differ in which the edges where the first profile 1, the second profile 2 and the third profile 3 are provided. FIG. 10 shows a top view of panel A of FIG. 1. FIG. 11 shows a top view of a panel B according to an embodiment of the invention. FIG. 12 shows a top view of a panel C according to an embodiment of the invention.

The edges of panel A (FIG. 10) are provided as follows:

the first edge comprises the groove-tongue profile 1, the third edge comprises the groove-double tongue profile 3; and the second and the fourth edge both comprise the groove profile 2.

The edges of panel B (FIG. 11) are provided as follows:

the first edge comprises the groove-double tongue profile 3, the third edge comprises the groove profile 2; and the second and the fourth edge both comprise the groove-tongue profile 1.

The edges of panel C (FIG. 12) are provided as follows:

the first edge comprises the groove-tongue profile 1, the third edge comprises the groove profile 2; and the second and the fourth edge both comprise the groove-double tongue profile 3.

The second and the fourth edge comprise in each of the three examples (panels A, B and C) the same profile selected from the first profile, the second profile or the third profile.

In case of rectangular panel A, B, C with two long edges and two short edges, the second and the fourth edge provide the short edges.

The groove-tongue profile 1 of the first profile, the groove profile 2 of the second profile and the groove-double tongue profile 3 of the third profile show in the direction perpendicular to the panel surface three levels. The groove-tongue profile 1 is divided in three levels by the tongue thickness F2 and F3 and by the groove thickness N5. The groove profile 2 is divided in three levels by the groove thicknesses N1, N2 and N3. The groove-double tongue profile 3 is divided in three levels by the groove width N4 and by the tongue thickness F4 and F5.

The first profile, the second profile and the third profile have been established by horizontal profiling. This differs from panels for glueless installation which comprise coupling parts that are profiled in horizontal and in vertical direction.

The three embodiments shown (panel A, panel B, panel C) allow to install the panels in different laying patterns, including herringbone, double herringbone, chessfield, braided, association, irregular association and cassette. The laying patterns involve that panels are installed including a 90° angle between the panels. No left and right hand side panels are required to make the laying patterns.

Figure 13:
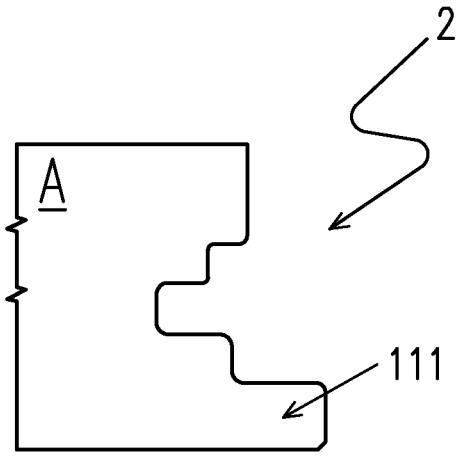
FIG. 13 shows the groove profile 2 of FIG. 5.
Figure 14:
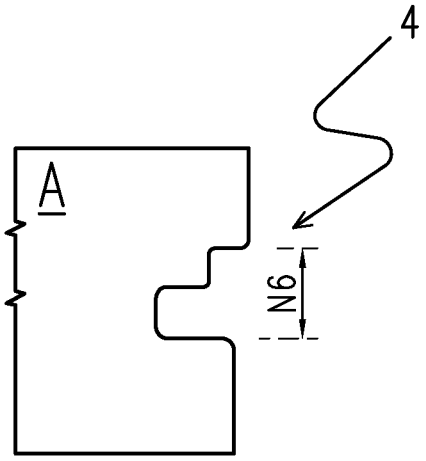
FIG. 14 shows the groove profile 2 of FIG. 5 wherein a bottom cheek of the groove of the groove profile 2 is removed.
Figure 16:
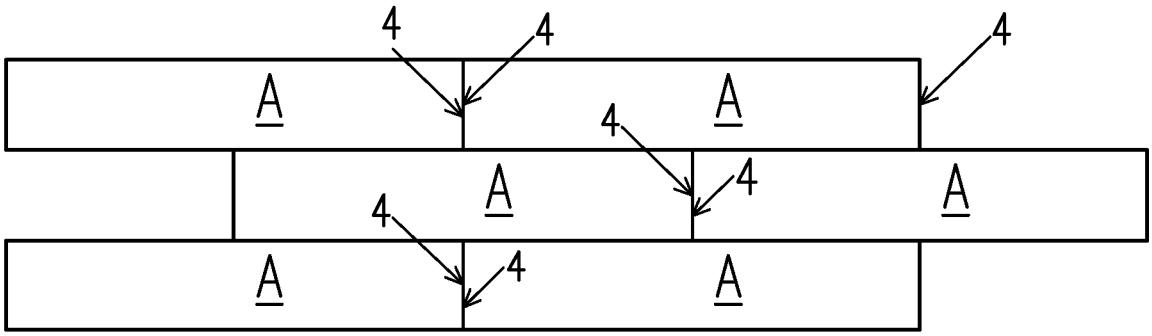
FIG. 16 shows an example of an installation of panels A installed parallel to each other, panels A according to an embodiment of the invention, panels A which comprise the profiles shown in FIGS. 3, 4 and 14.

An embodiment of the first aspect of the invention according to panel A also allows an installation of the panels in linear rows, as is shown in FIG. 16, when the bottom cheek 111 of the groove profile 2 is cut, such that the distal end of the bottom cheek 111 extends up to the vertical plane comprising the closing plane 101 or ends more proximal than the vertical plane comprising the closing plane 101. FIGS. 13 and 14 illustrate the cutting of the bottom cheek 111 (FIG. 13 shows the groove profile 2 in uncut condition, FIG. 14 shows a groove profile 4 with shortened bottom cheek).

Figure 15:
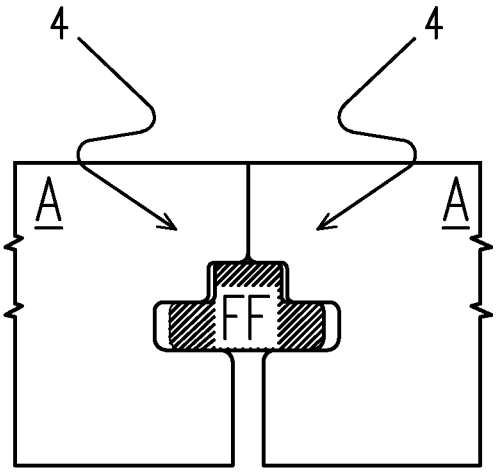
FIG. 15 shows the coupling of two profiles as shown in FIG. 14 with an insert.

FIG. 15 shows the coupling of two profiles 4 as shown in FIG. 14 with an insert FF. The closing planes contact each other, the coupling of two panel edges with profile 4 is performed by means of an insert FF. The insert FF being shown has a T-shape cross section. The thickness of the insert FF corresponds with the groove width, such that the insert can be used for coupling the panel edges provided with profile 4.

By changing the nut profile into a profile 4 as shown in FIG. 14, the linear installation of panels shown in FIG. 16 can be realized. This allows to realize more and more complex laying patterns.

Figure 17:
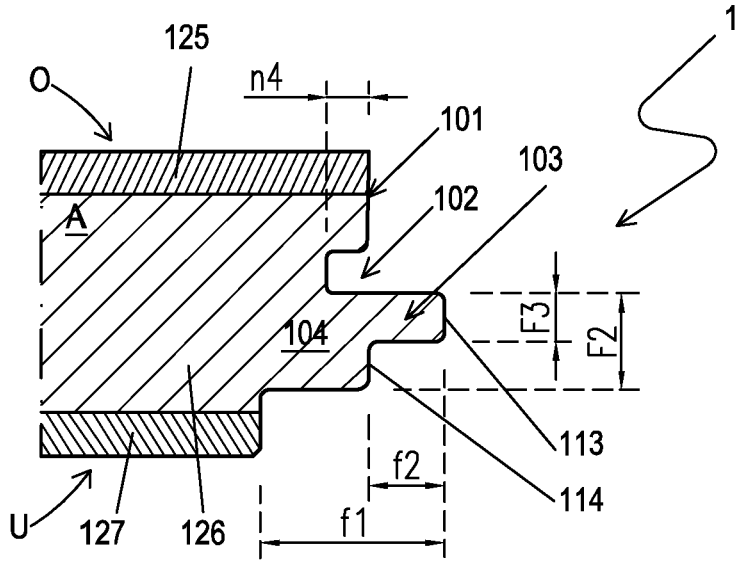
FIG. 17 shows a cross section of a groove-tongue profile according to an embodiment of the invention in a panel comprising three layers of wood.

FIG. 17 shows a panel edge comprising a groove-tongue profile as in the first aspect of the invention. The groove-tongue profile is similar to the groove-tongue profile 1 shown in FIG. 3; the reference numbers in FIG. 17 have the same meaning as in FIG. 3. The panel of the example of FIG. 17 comprises three layers of wood 125, 126, 127. The layers of wood comprise a first layer of wood 125, a second layer 126 of wood and a third layer 127 of wood. The second layer of wood is provided between the first layer of wood and the third layer of wood. The continuous tongue 104 of the first groove-tongue profile 1 is provided in the second layer 126 of wood.

FIGS. 18-28 illustrate embodiments of panels according to the sixth aspect of the invention.

Figure 18:
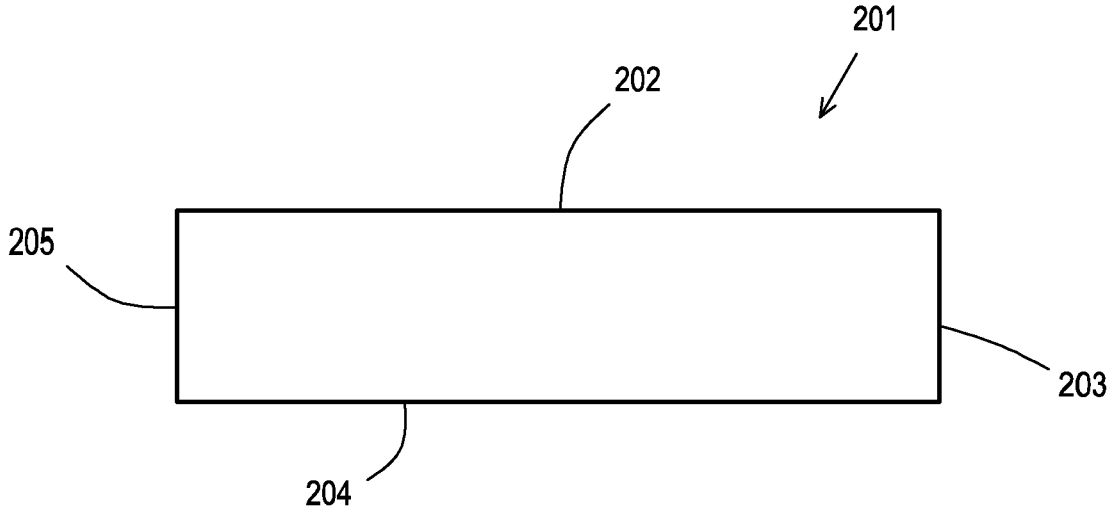
FIG. 18 shows a panel according to the sixth aspect of the invention.

FIG. 18 shows a panel 201 according to the sixth aspect of the invention. The panel 201 is rectangular, square or oblong. The panel comprises a first edge 202 and a third edge 204. The first edge and the third edges are provided opposite to each other. The panel comprises a second edge 203 and a fourth edge 205, wherein the second edge and the fourth edge are provided opposite to each other. Each of the first edge, the second edge, the third edge and the fourth edge comprise a profile selected from a first profile, a second profile and a third profile. Both short edges can e.g. be provided with the second profile.

Figure 19A:
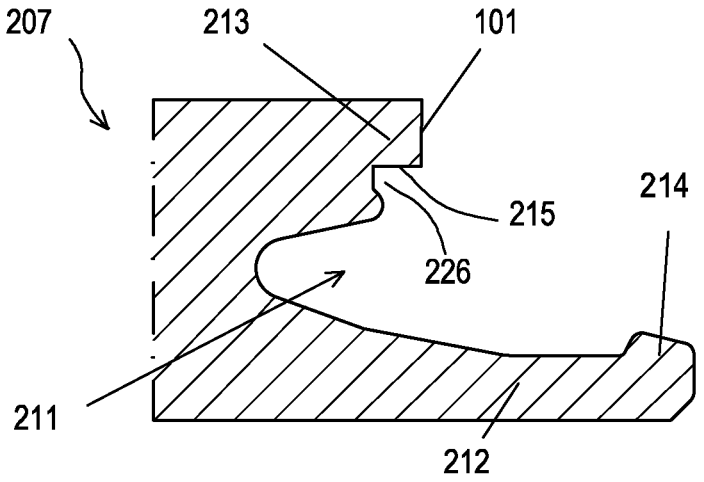
FIGS. 19*a-c* show an example of profiles of edges of the panel of FIG. 18.
Figure 19B:
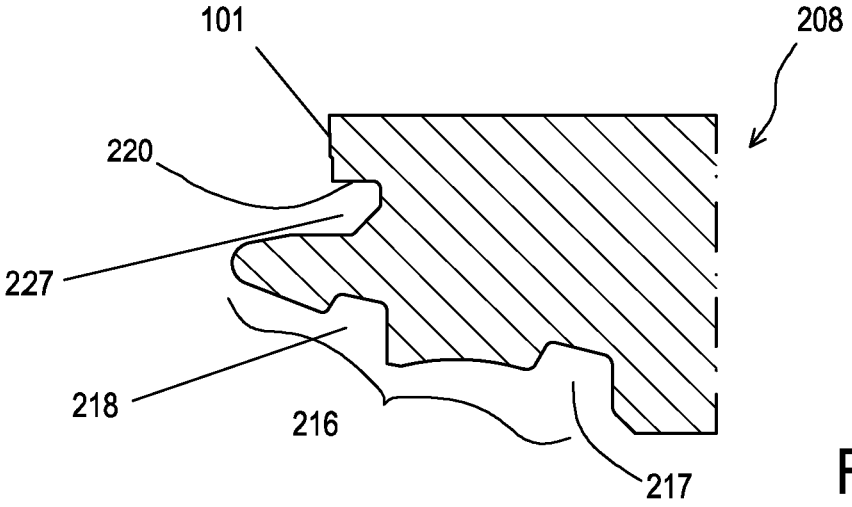
Figure 19C:
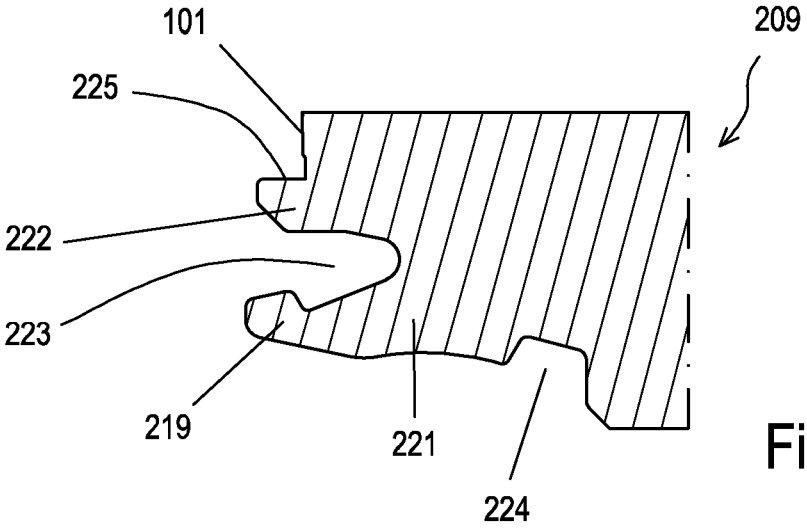
Figure 21A:
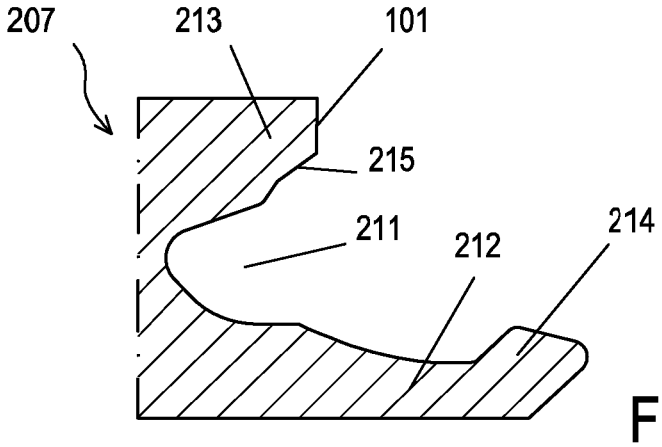
FIGS. 21*a-c* show an example of profiles of edges of the panel of FIG. 18.
Figure 21B:
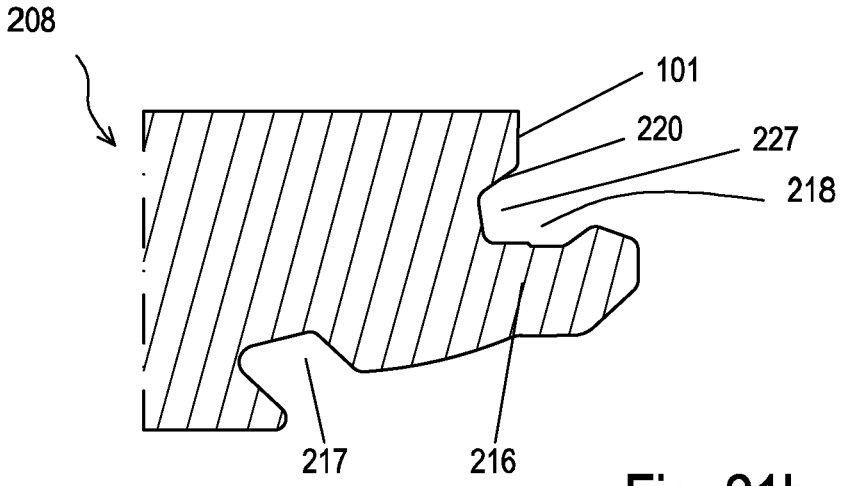
Figure 21C:
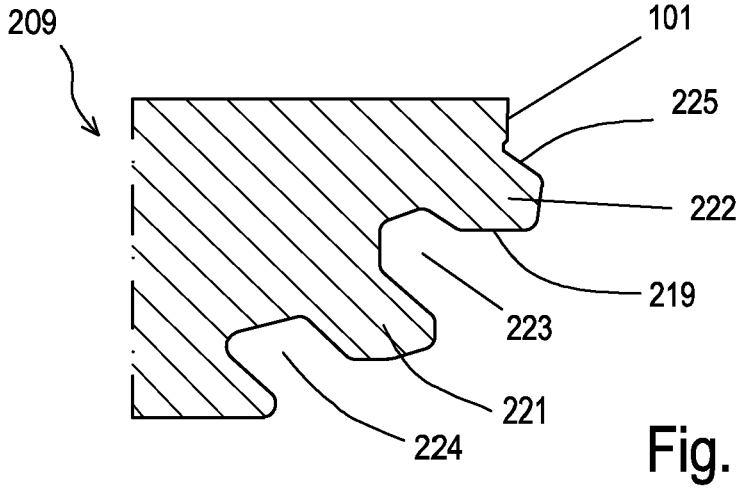
Figure 23A:
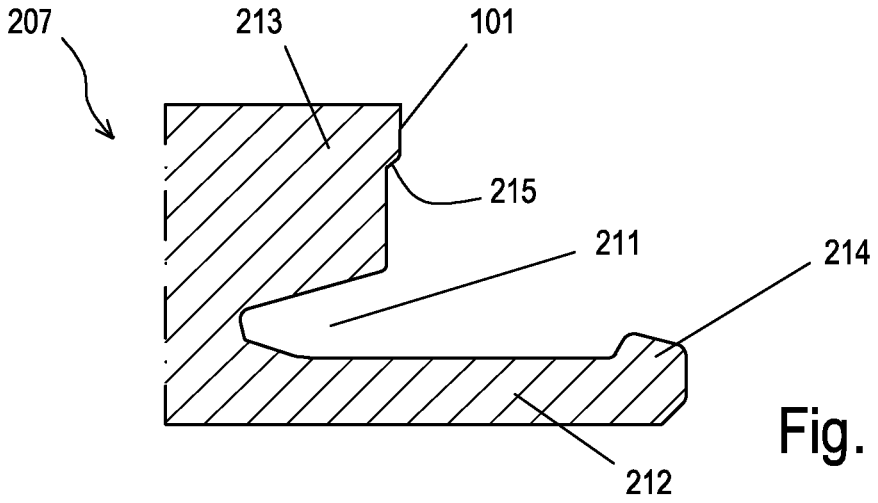
FIGS. 23*a-c* show an example of profiles of edges of the panel of FIG. 18.
Figure 23B:
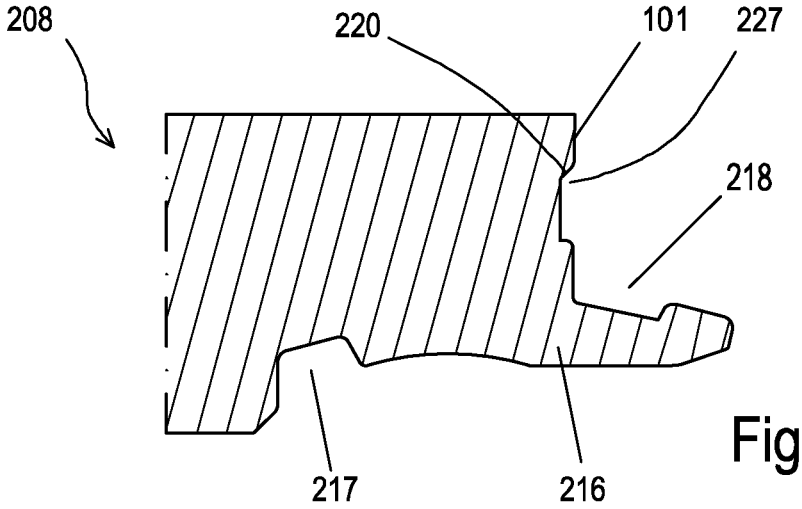
Figure 23C:
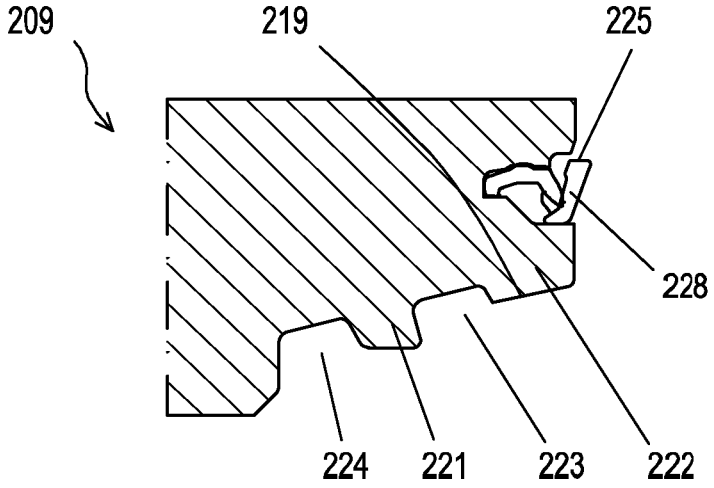

FIGS. 19*a-c* show a first example of a set of a first profile 207, a second profile 208 and a third profile 209 that can be used in the panel according to the sixth aspect of the invention shown in FIG. 18. FIGS. 21*a-c* show a first example of a set of a first profile 207, a second profile 208 and a third profile 209 that can be used in the panel according to the sixth aspect of the invention shown in FIG. 18. FIGS. 23*a-c* show a first example of a set of a first profile 207, a second profile 208 and a third profile 209 that can be used in the panel according to the sixth aspect of the invention shown in FIG. 18. The reference numbers in these drawings have the same meaning.

The first profile 207, the second profile 208 and the third profile 209 are configured such that a panel edge comprising the first profile can be coupled to the edge of another such panel wherein the edge of the another such panel comprises any one of the second profile or the third profile, wherein in the coupled condition a locking of the coupled edges is provided in the direction perpendicular to the coupled panels as well as in the direction perpendicular to the coupled edges and parallel with the surface of the coupled panels;

and such that a panel edge comprising the second profile can be coupled to the edge of another such panel wherein the edge of the another such panel comprises the third profile, wherein in the coupled condition a locking of the coupled edges is provided in the direction perpendicular to the coupled panels as well as in the direction perpendicular to the coupled edges and parallel with the surface of the coupled panels.

In the examples shown, each of the first profile 207, the second profile 208 and the third profile 209 extend continuously and without interruption along the edge(s) where they are provided. In the examples shown, each of the first profile 207, the second profile 208 and the third profile 209 have a constant cross section perpendicularly to the edge where they are provided, over the full length of the edge where they are provided. In the examples shown, each of the first profile 207, the second profile 208 and the third profile 209 extend along the full length of the panel edge(s) where they are provided.

Figure 20A:
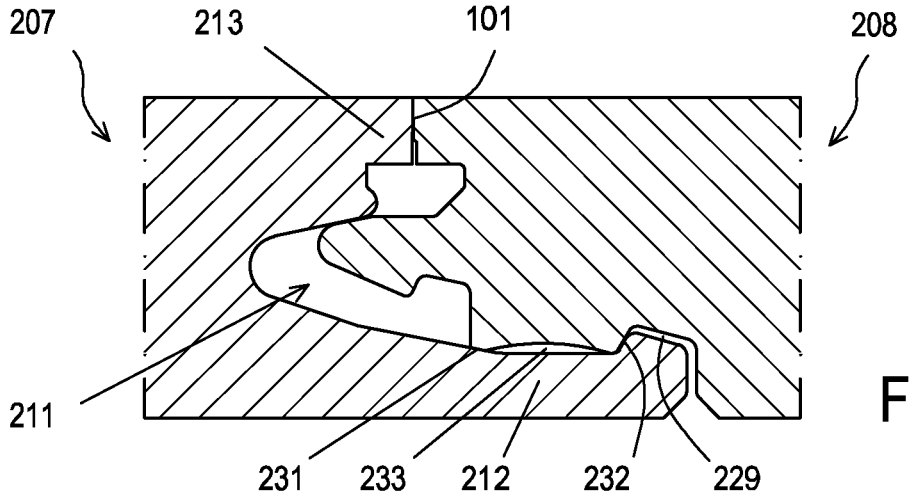
FIGS. 20*a-c* show the edge profiles of FIGS. 19*a-c* in coupled condition.
Figure 20B:
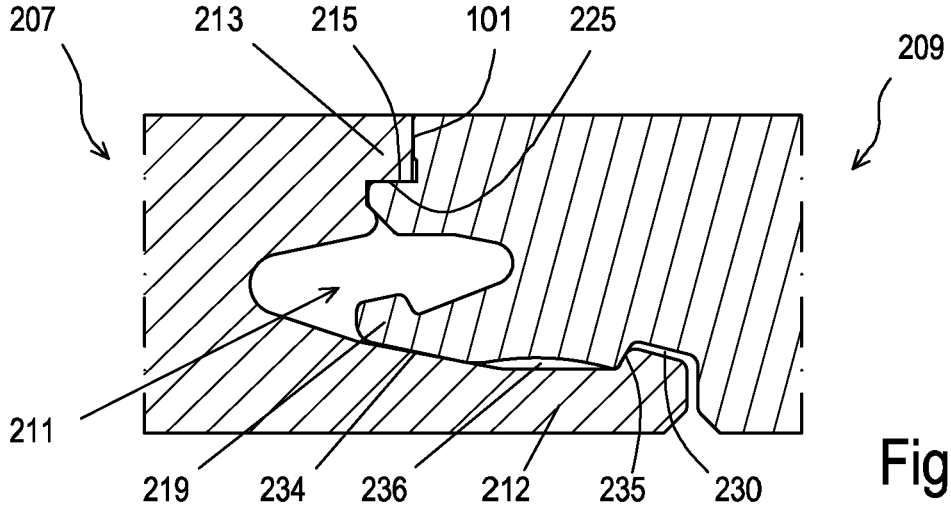
Figure 20C:
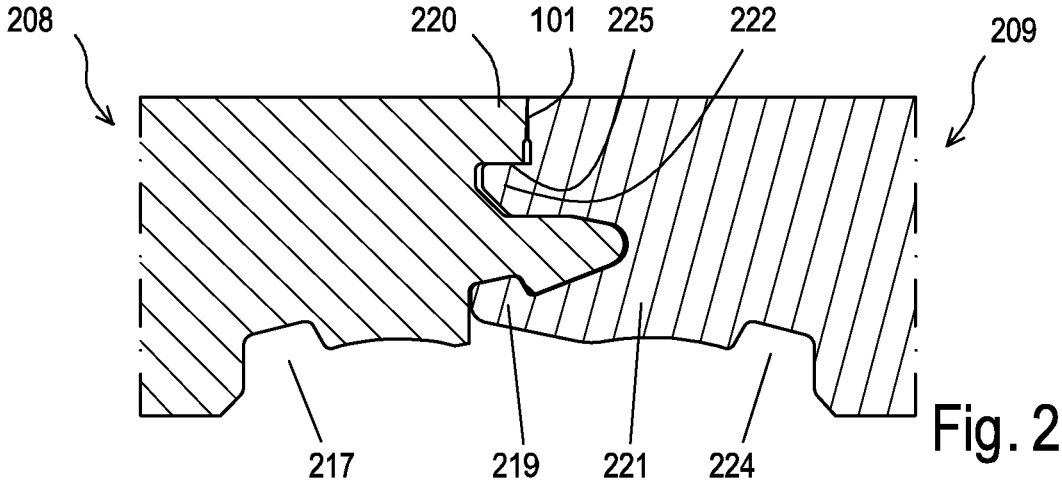
Figure 22A:
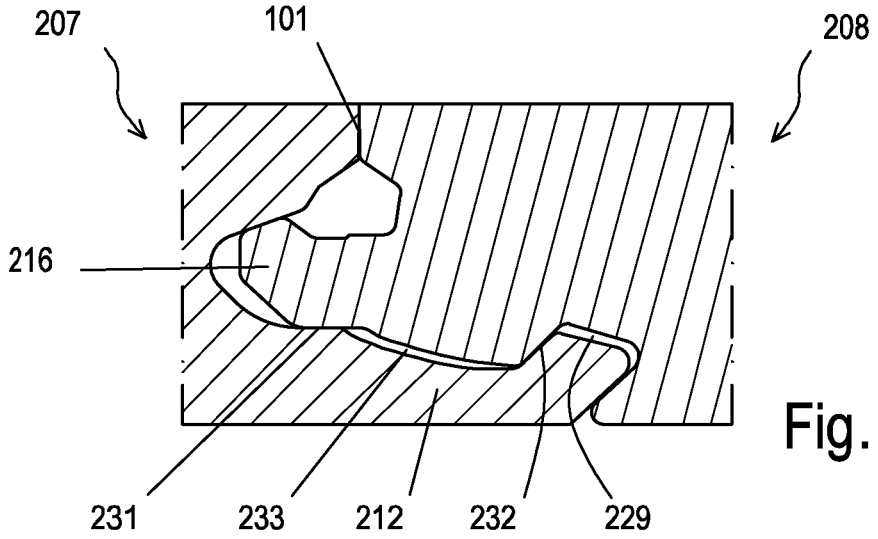
FIGS. 22*a-c* show the edge profiles of FIGS. 21*a-c* in coupled condition.
Figure 22B:
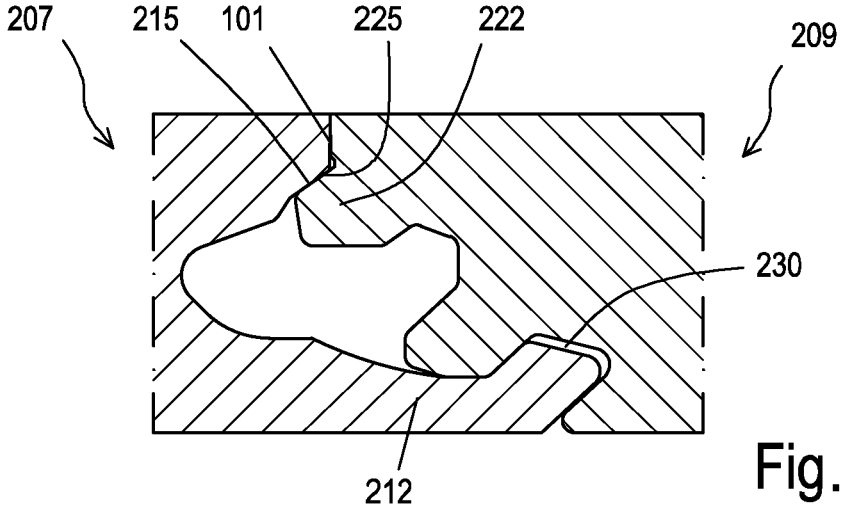
Figure 22C:
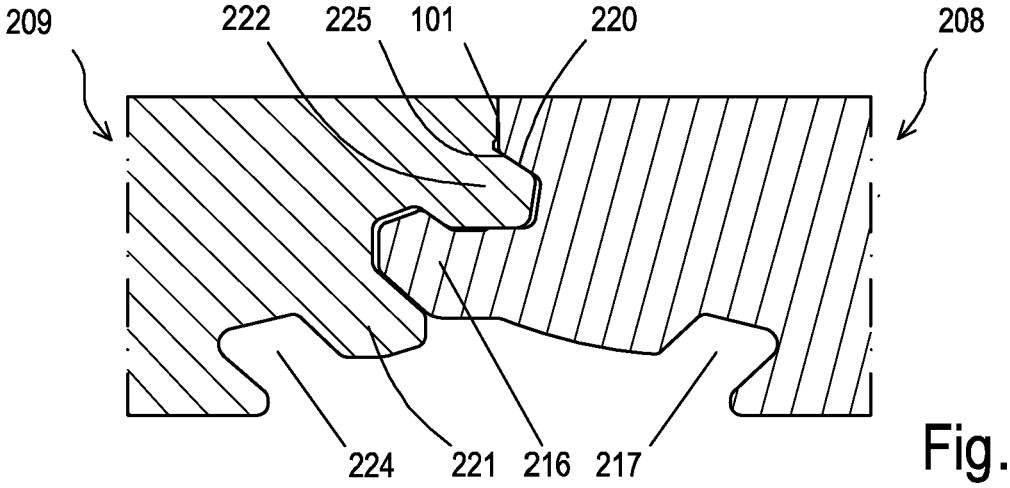
Figure 24A:
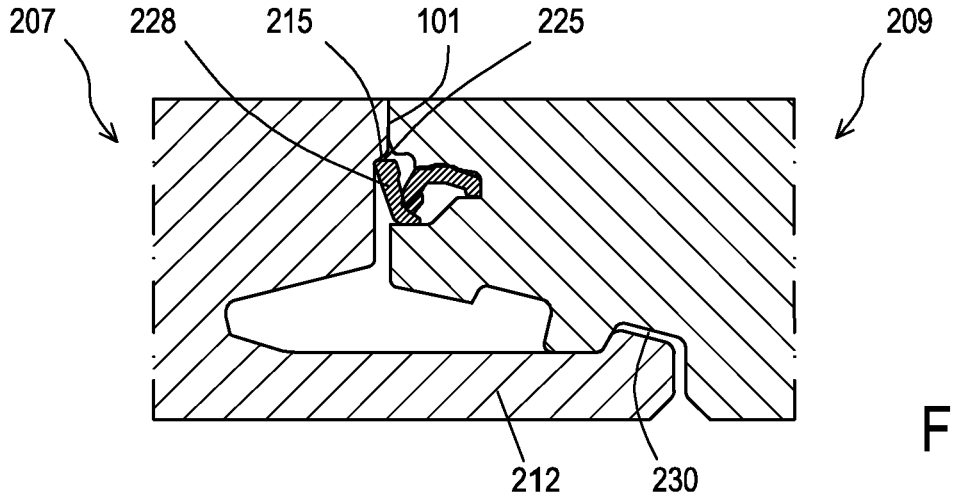
FIGS. 24*a-c* show the edge profiles of FIGS. 23*a-c* in coupled condition.
Figure 24B:
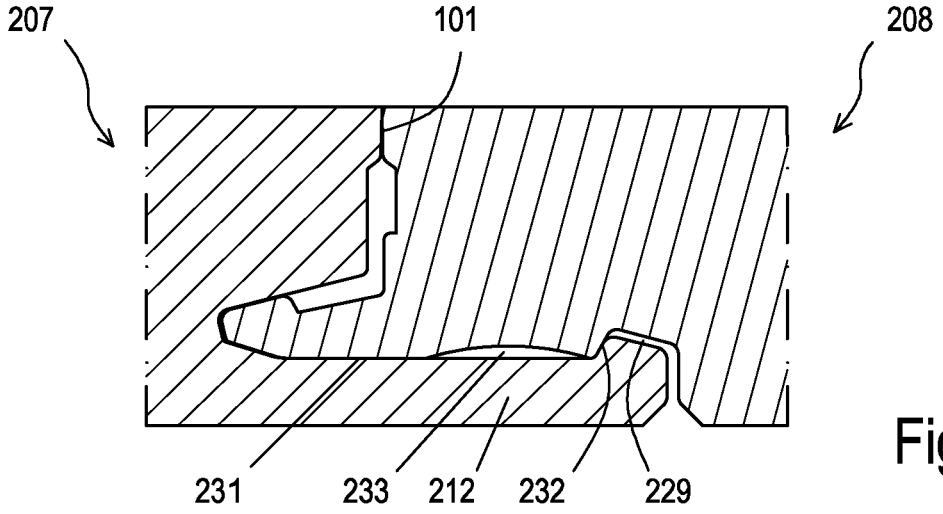
Figure 24C:
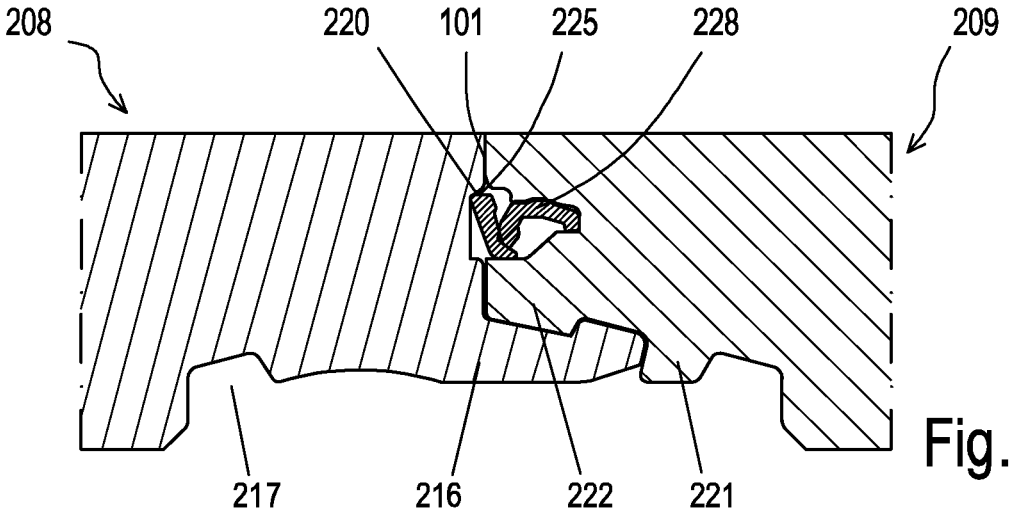

FIGS. 20*a-c* show the edge profiles of FIGS. 19*a-c* in coupled condition. FIGS. 22*a-c* show the edge profiles of FIGS. 21*a-c* in coupled condition. FIGS. 24*a-c* show the edge profiles of FIGS. 23*a-c* in coupled condition.

In the examples shown in FIGS. 19-25, the first profile 207 comprises a groove 211. The groove is bordered by a lower lip 212 and by an upper lip. The lower lip extends distally to beyond the upper lip. The lower lip comprises at its distal end a locking element 214. The locking element 214 of the lower lip 212 of the first profile 207 is directed upwards. The locking element 214 is provided for realizing a locking in the direction perpendicular to the coupled edges and parallel with the panel surface when a panel edge comprising the first profile 207 is coupled to the edge of another such panel when said edge of the another such panel comprises any one of the second profile 208 or the third profile 209. The upper lip 213 comprises a locking surface 215. The locking surface 215 can be provided parallel to (as is shown in the embodiments shown in FIG. 19*a* and in FIG. 25) or inclined (as is shown in the embodiments shown in FIGS. 21*a* and 23*a*) with respect to the surface of the panel.

The locking surface 215 is provided for establishing a locking in the direction perpendicular to the panel surface when a panel edge comprising the first profile is coupled to the edge of another such panel when said edge of the another such panel comprises the third profile.

The second profile 208 comprises a tongue 216. The tongue 216 is configured for insertion in the groove 211 of the first profile 207 of an edge of another such panel, thereby establishing a locking in the direction perpendicular to the surface of the so coupled panels.

The tongue 216 comprises a first recess 217. The first recess is suited for cooperation with the locking element 214 of the first profile 207 of an edge of another such panel thereby establishing a locking of the so-coupled panels in the direction perpendicular to the coupled edges and parallel with the panel surface. The tongue 216 comprises a second recess 218. The second recess is suited for cooperation with the locking element 219 of the third profile 209 of an edge of another such panel thereby establishing a locking of the so-coupled panels in the direction perpendicular to the coupled edges and parallel with the panel surface. The first recess 217 and the second recess 218 can be provided at different sides of the tongue 216, as is shown in the embodiments represented in FIGS. 21*b*, 23*b* and 25, in these embodiments, the first recess 217 is provided at the bottom of the tongue. In the embodiment shown in FIG. 19*b*, the first recess 217 and the second recess 218 are both provided at the bottom of the tongue 216.

The second profile 208 comprises closer to the panel surface than the location of the tongue 216, a locking surface 220. This locking surface 220 can be provided parallel to (as is shown in the embodiments shown in FIG. 19*b* and in FIG. 25) or inclined (as is shown in the embodiments shown in FIGS. 21*b* and 23*b*) with respect to the surface of the panel. In the examples shown, the locking surface 220 of the second profile 208 is provided at the upper side of an undercut 227 in the second profile. This locking surface 220 is provided for establishing a locking in the direction perpendicular to the panel surface when a panel edge comprising the second profile is coupled to the edge of another such panel when said edge of the another such panel comprises the third profile 209.

The third profile 209 comprises a first tongue 221 and a second tongue 222. The second tongue 222 is provided closer to the panel surface than the first tongue 221. A second groove 223 is provided between the first tongue and the second tongue. The first tongue comprises at its bottom a recess 224. This recess 224 is provided for establishing, in cooperation with the locking element 214 of the lower lip of the first profile, a locking in the direction perpendicular to the coupled edges and parallel with the surface of the panel when a panel edge comprising the third profile is coupled onto the edge comprising the first profile of another such panel. The second tongue 222 comprises a locking surface 225 for establishing a locking in the direction perpendicular to the surface of the panels in combination with the locking surface of the first profile or the locking surface of the second profile, when a panel edge comprising the third profile is coupled to an edge of another such panel comprising the first profile respectively the second profile. The first tongue 221 or the second tongue 222 comprises a locking element 219, which is provided for establishing in combination with the second recess 218 of the second profile a locking in the direction perpendicular to the coupled edges and parallel with the panel surface when a panel edge comprising the third profile is coupled to the edge comprising the second profile of another such panel.

In each of the examples shown in FIGS. 19-28, the profiles are configured such that in coupled condition of an edge comprising the first profile 207 to an edge comprising the second profile 208 of another such panel, a gap 229 is provided between the upper surface of the locking element 214 of the first profile and the edge of the another panel. This is e.g. illustrated in FIGS. 20*a*, 22*a*, 24*b*, and 25*b*.

In each of the examples shown in FIGS. 19-28, the profiles are configured such that in coupled condition of an edge comprising the first profile 207 to an edge comprising the third profile 209 of another such panel, a gap 230 is provided between the upper surface of the locking element 214 of the first profile and the edge of the another panel. This is e.g. illustrated in FIGS. 20*b*, 22*b*, 24*a*, and 25*a*.

In each of the examples shown in FIGS. 19-28, the profiles are configured such that in coupled condition of an edge comprising the first profile 207 to an edge comprising the second profile 208 of another such panel, the lower lip 212 of the first profile contacts the second profile 208 of the edge of the another such panel in two distinct zones 231, 232, wherein a gap 233 is provided between said two distinct zones. This is e.g. illustrated in FIGS. 20*a*, 22*a*, 24*b*, and 25*b*.

In each of the examples shown in FIGS. 19-28, the profiles are configured such that in coupled condition of an edge comprising the first profile 207 to an edge comprising the third profile 209 of another such panel, the lower lip 212 of the first profile contacts the bottom of the first tongue of the second profile of the edge of the another such panel in two distinct zones 234, 235, wherein a gap 236 is provided between said two distinct zones. This is e.g. illustrated in FIGS. 20*b*, 22*b*, 24*a*, and 25*a*.

In each of the examples shown in FIGS. 19-28, each of the first edge, the second edge, the third edge and the fourth edge are provided closer to the panel surface than the first profile, the second profile and the third profile with a closing plane 101. The closing planes 101 are provided perpendicularly to the panel surface. In coupled condition of two panels the closing planes of the panel edges coupled to each other contact each other or are positioned closely to each other.

In the example shown in FIG. 19 (and in FIG. 20 in coupled condition), the locking surface 215 of the upper lip 215 of the first profile is provided at the upper surface of an additional groove 226 closer to the panel surface than the groove 211 of the first profile.

In the examples shown in FIGS. 21 (and in coupled condition in FIG. 22), 23 (and in coupled condition in FIG. 24) and 25 the locking surface 215 of the upper lip 213 of the first profile 207 is provided as an inclined surface at the distal edge of the upper lip.

In the examples shown in FIGS. 19 (and in FIG. 20 in coupled condition) and 21 (and in FIG. 22 in coupled condition) an upper surface of the second tongue 222 provides the locking surface 225 of the third profile.

Figure 25A:
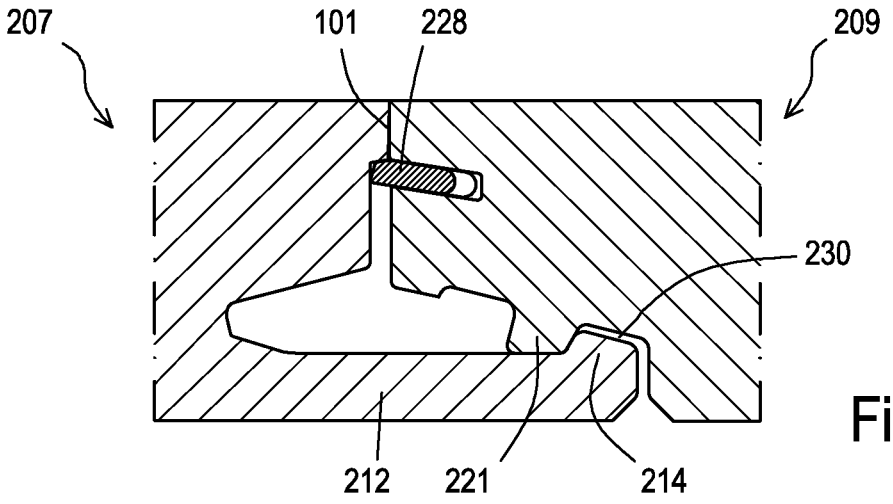
FIGS. 25*a-c* show the edge profiles in coupled condition of another example of the sixth aspect of the invention.
Figure 25B:
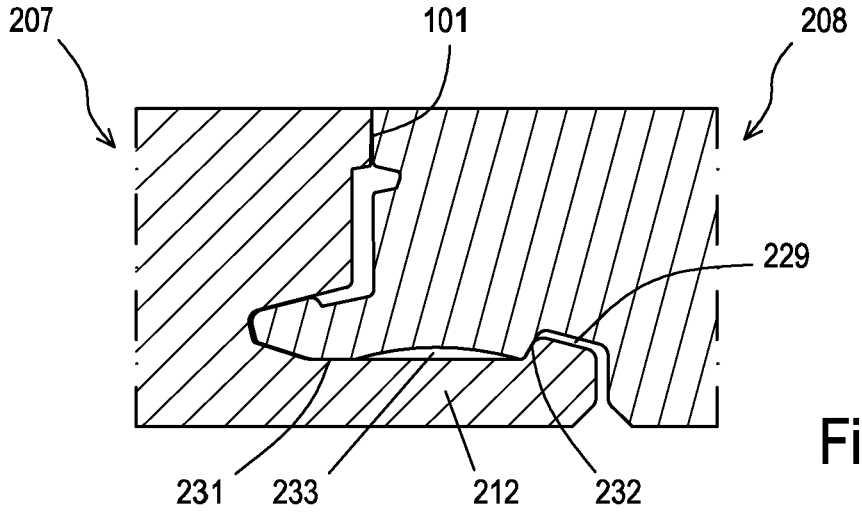
Figure 25C:
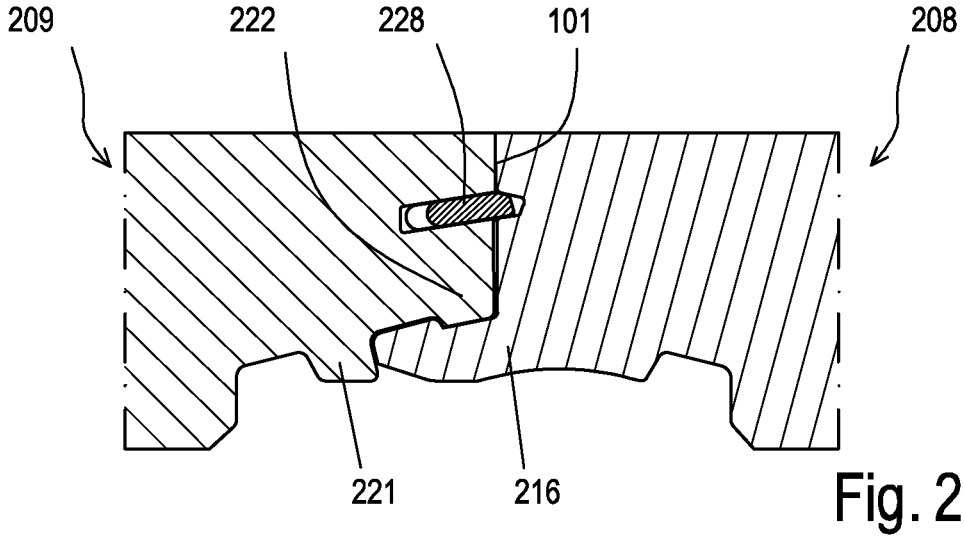

In the examples shown in FIGS. 23 (and in FIG. 24 in coupled condition) and 25 (showing the edge profiles in coupled condition) the locking surface 225 of the second tongue 222 is provided by a separate insert 228 inserted in the second tongue 222. A displacement of the locking surface 225—caused by a displacement or deformation (e.g. an elastic deformation) of at least part of the insert 228 during the coupling of the panel edges provides for the locking in the direction perpendicular to the surface of the panel caused by a sliding or a rotational movement and/or an elastic bending of the insert when coupling the panel edges results in the locking in the direction perpendicular to the surface of the panel. FIG. 23*c* (and FIG. 24 in coupled condition) shows an example of insert 228 that can be used. FIG. 25 show another example of an insert 228 that can be used, which provided the coupling by a sliding movement of at least part of the insert.

The examples of the first profile 207, second profile 208 and the third profile 209 shown in FIGS. 19-25 are such that the two panel edges that—according to the sixth aspect of the invention—both comprise the same profile selected from the first profile 207, the second profile 208 or the third profile 209, comprise profiles that have the same cross section perpendicular to the panel edge where the profiles are provided.

The panel example of FIG. 18 is described can e.g. at both short edges 203, 205 comprise the second profile 208.

The sixth aspect of the invention also provides that the two edges comprising the same profile selected from the first profile, the second profile and the third profile, comprise profiles selected from the first profile or the second profile or the third profile that differ in cross section perpendicular to the panel edge where the profiles are provided. Examples of such embodiments are illustrated in FIGS. 26-28. The reference numbers in FIGS. 26-28 have the same meaning as in the FIGS. 19-25.

FIG. 26*a-d* show an example of the profiles at the four edges of a rectangular and oblong panel. FIGS. 27*a-e* show the edge profiles in coupled condition of the profile edges shown in FIG. 26. FIG. 28*a-e* show the edge profiles in coupled condition of another such embodiment. FIGS. 26*a-d* illustrate the four profiles, one provided at each of the four panel edges of a rectangular and oblong panel. The first profile 207 is provided at one of the panel edges. The first profile 207 shown in FIG. 26*a* corresponds to a large extent to the first profile shown in FIG. 19*a*.

Figure 26A:
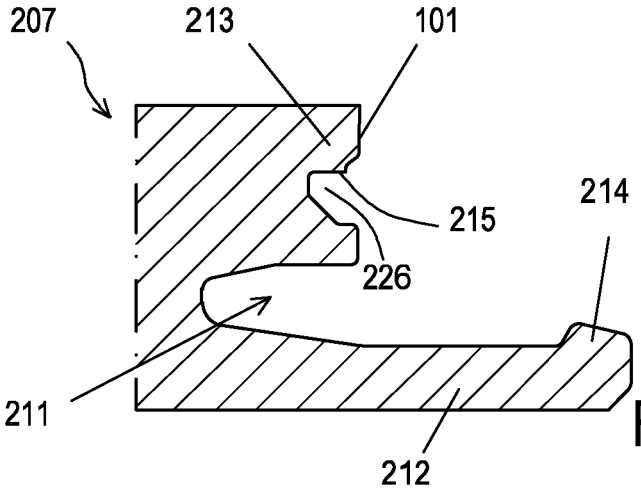
FIG. 26*a-d* show an example of the profiles of edges of another example of a panel according to FIG. 18.
Figure 26B:
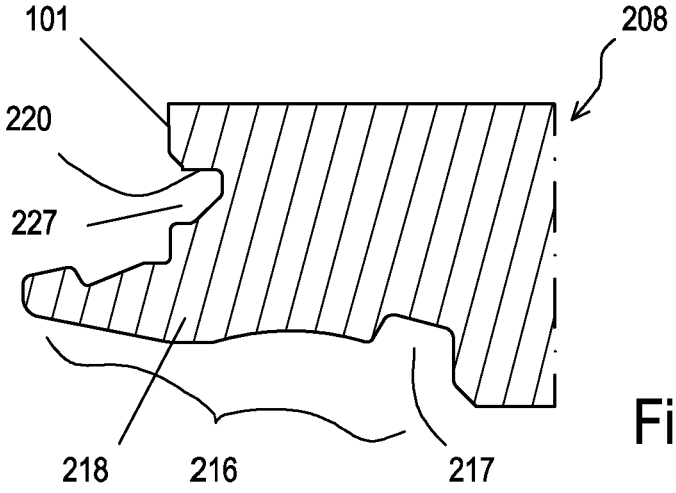
Figure 26C:
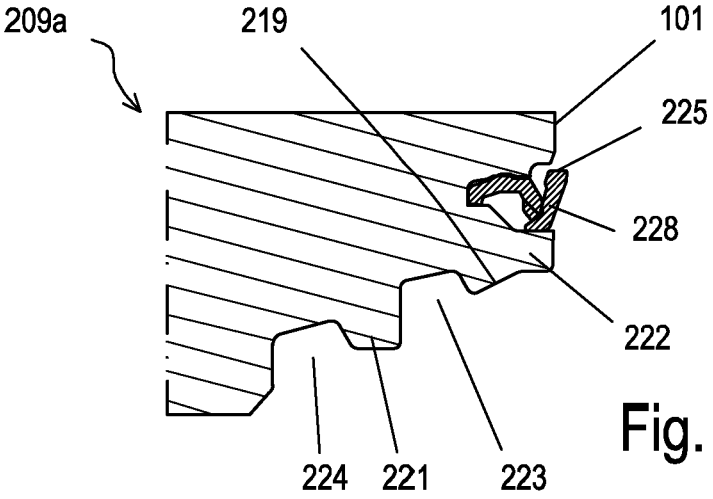
Figure 26D:
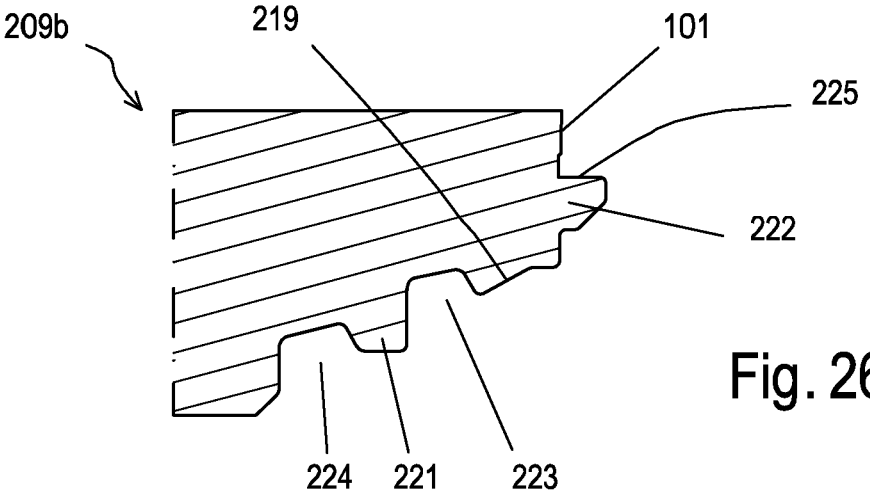
Figure 27A:
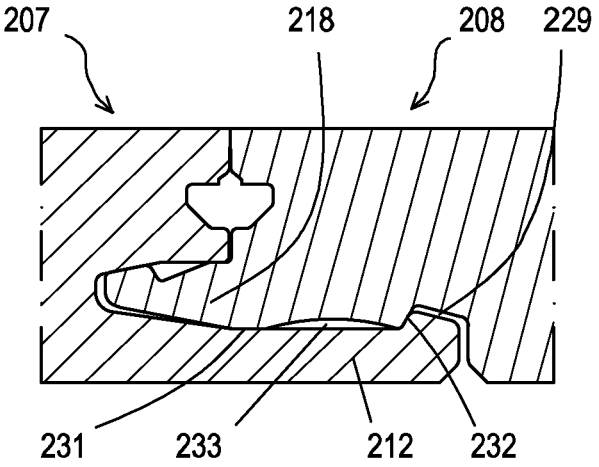
FIGS. 27*a-e* show the edge profiles in coupled condition of the profile edges shown in FIG. 26.
Figure 27B:
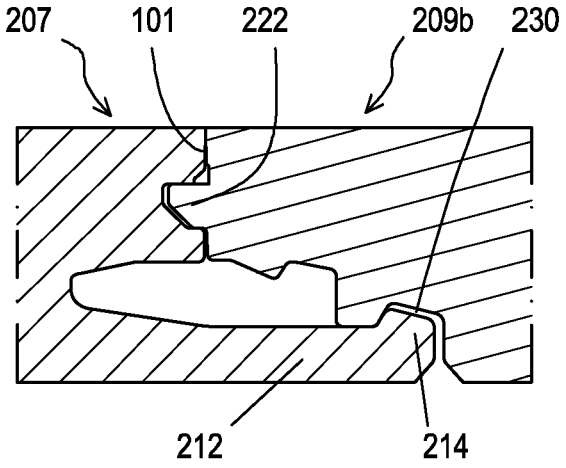
Figure 27C:
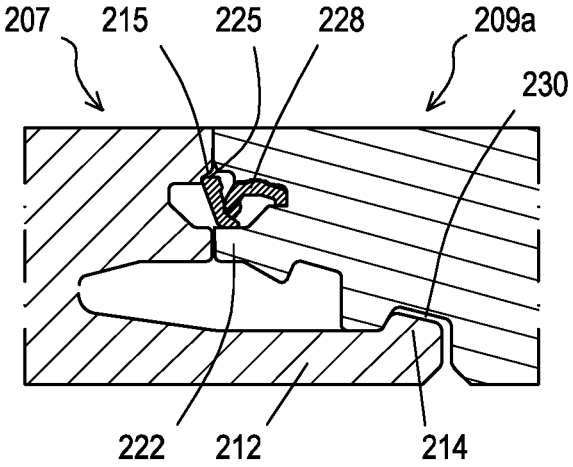
Figure 27D:
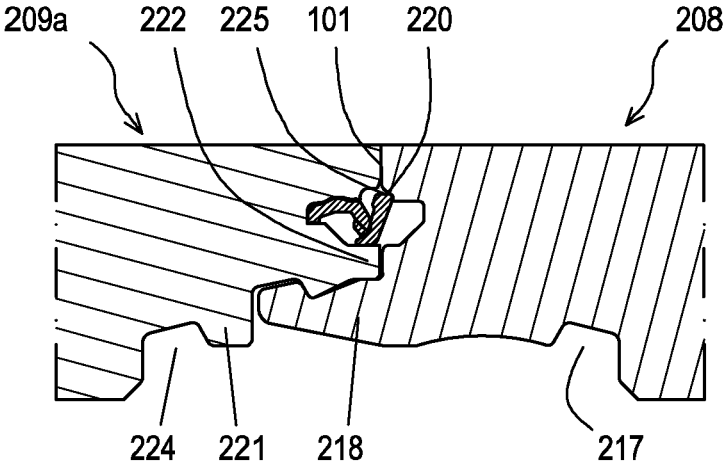
Figure 27E:
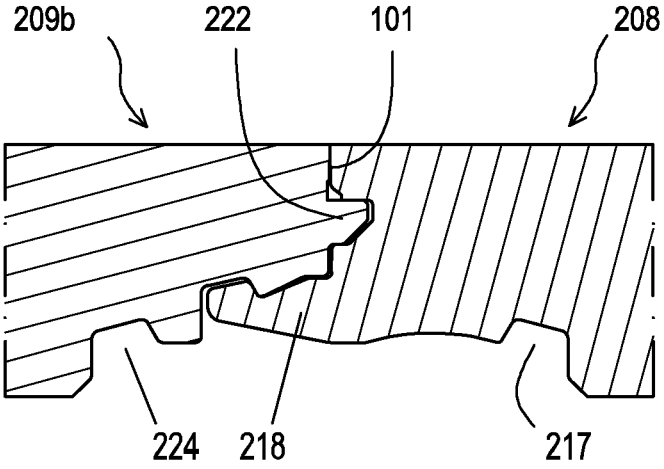
Figure 28A:
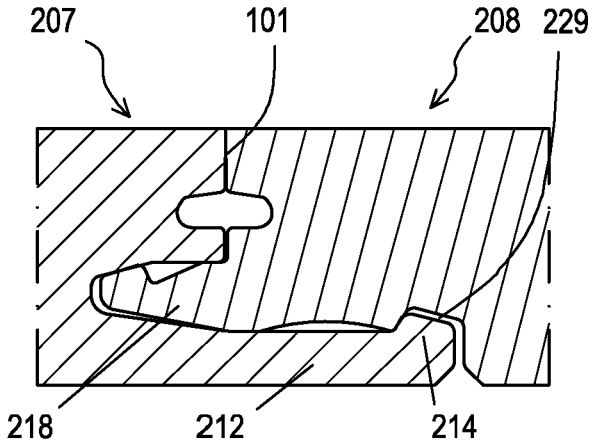
FIG. 28*a-e* show the edge profiles in coupled condition of another embodiment of sixth aspect of the invention.
Figure 28B:
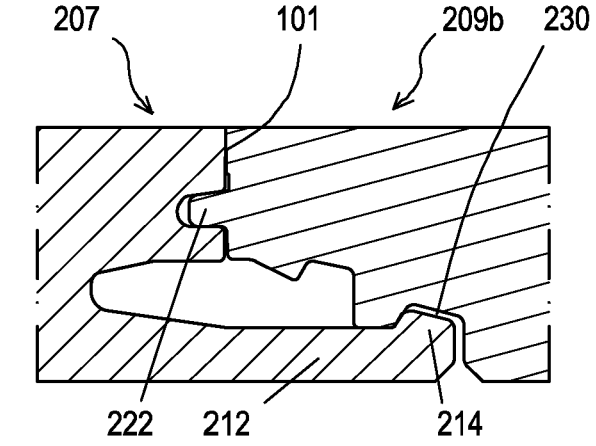
Figure 28C:
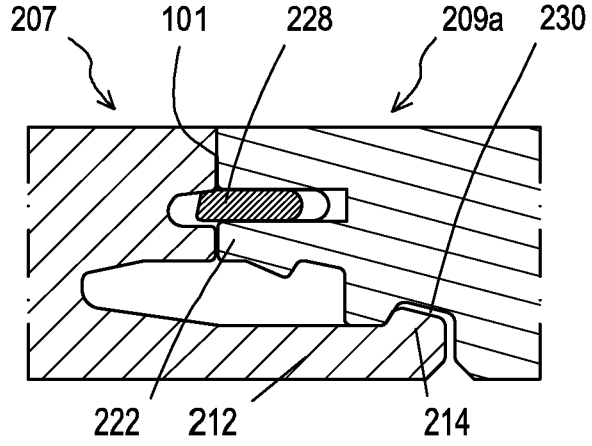
Figure 28D:
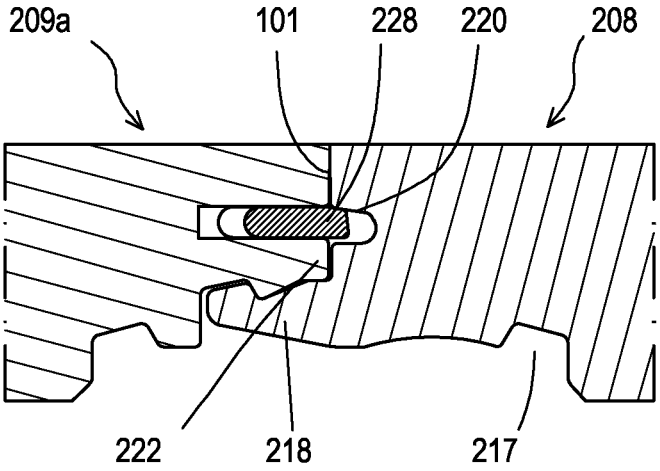
Figure 28E:
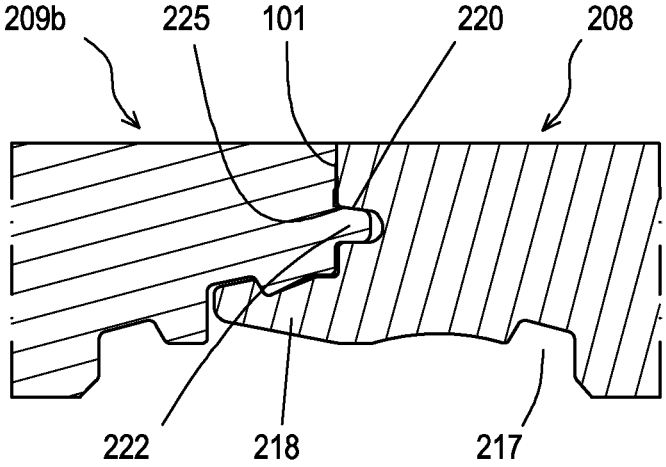

The second profile 208 shown in FIG. 26*b* is provided at one of the panel edges.

Two—preferably opposite—panel edges (e.g. both short edges) are each provided with a different configuration of a third profile 209*a*, 209*b*. The two configurations of the third profile 209*a*, 209*b* differ in cross section perpendicular to the panel edge where the profiles are provided.

In the example shown in FIGS. 26 and 27 (which show the edges in coupled condition), in the first configuration of the third profile 209*a* the locking surface of the second tongue 222 is provided by a separate insert 225 inserted in the second tongue. The insert is elastically deformable such that the coupling with locking of the coupled edges in the direction perpendicular to the panel surface can be realized. In the second configuration of the third profile 209*b* an upper surface of the second tongue 222 provides the locking surface 225 of the third profile 209*b*.

FIG. 28 show—in coupled condition—an alternative for the embodiment shown in FIGS. 26 and 27. The profiles (the first profile 207, the second profile 208, and both third profiles 209*a*, 209*b*) are to a large extent similar to the ones shown is FIGS. 26 and 27, major difference being the different type of insert 228 being inserted in the first configuration of the third profile 209*a*. In this example, the locking is obtained via a sliding movement of the locking surface 225 during coupling. To this end, an elastic movement during the coupling of the related panel edges is possible of at least part of the insert 228 in the slot in the second tongue 222 in which the inert 228 is provided.

The panels of the sixth aspect of the invention can be installed in laying patterns wherein the panels are coupled to each other under a 90° angle, e.g. as in the herringbone configuration shown in FIG. 9.

FIGS. 29, 30*a-d* and 31*a-f* illustrate in combination an embodiment of the ninth aspect of the invention.

Figure 29:
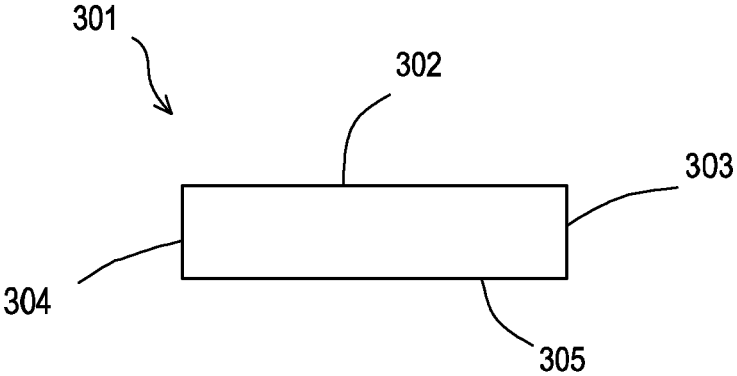
FIG. 29 shows a panel according to the ninth aspect of the invention.
Figure 30A:
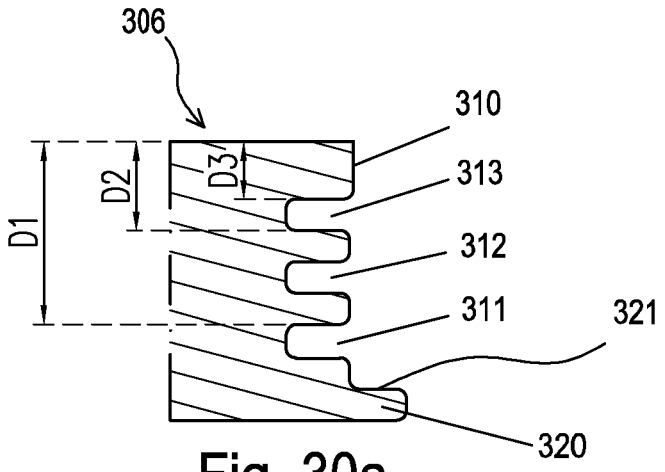
FIGS. 30*a-d* shows an example of the coupling profiles of the panel according to the ninth aspect of the invention shown in FIG. 29.
Figure 30B:
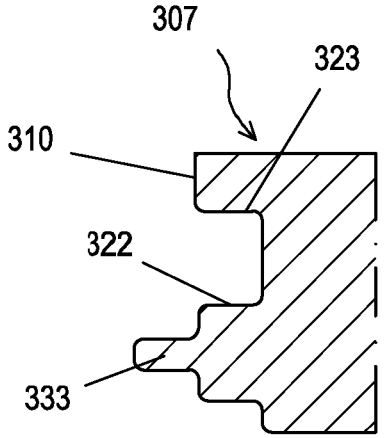
Figure 30C:
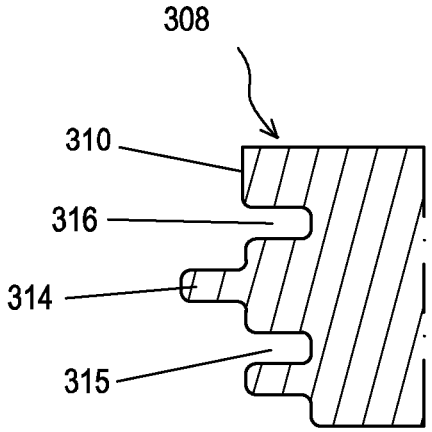
Figure 30D:
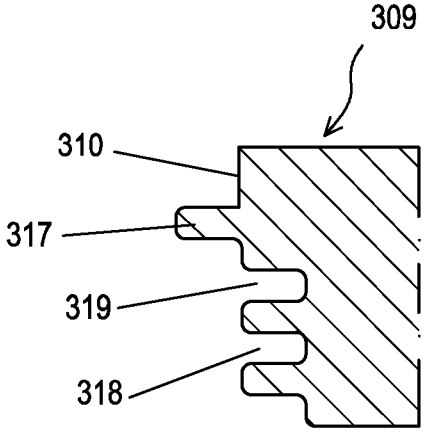

FIG. 29 shows a panel 301 according to the ninth aspect of the invention. The panel 301 is rectangular and oblong. The panel 301 comprises a first edge 302, a second edge 303, a third edge 304, and a fourth edge 305. In the example shown, the first and the fourth edge are provided at the long edges of the panel and the second and the third edge are provide at the short edges of the panel.

FIGS. 30*a-d* show an example of the coupling profiles of the panel according to the ninth aspect of the invention shown in FIG. 29. The first edge 302 of the panel of FIG. 29 is provided with a first coupling profile 306 shown in FIG. 30*a*. The second edge 303 is provided with a second coupling profile 307 shown in FIG. 30*b*. The third edge 304 is provided with a third coupling profile 308 shown in FIG. 30*c*. The fourth edge 305 is provided with a fourth coupling profile 309 shown in FIG. 30*d*.

Each of the first coupling profile 306, the second coupling profile 307, the third coupling profile 308 and the fourth coupling profile 309 extend along the full length of the panel edge where they are provided.

Each of the first coupling profile 306, the second coupling profile 307, the third coupling profile 308 and the fourth coupling profile 309 have along the length of the panel edge where they are provided a constant cross section perpendicular to the panel edge where they are provided.

Each of the first coupling profile 306, the second coupling profile 307, the third coupling profile 308 and the fourth coupling 309 profile extend continuously along the edge where they are provided.

The first coupling profile 306 comprises a first groove 311 at a first distance D1 from the panel surface, a second groove 312 at a second distance D2 from the panel surface and a third groove 313 at a third distance D3 from the panel surface. The third distance D3 is smaller than the second distance D2 and wherein the second distance D2 is smaller than the first distance D1.

The second coupling profile 307 comprises a first tongue 333. The third coupling profile 308 comprises a second tongue 314, a fourth groove 315 and a fifth groove 316. The fourth coupling profile 309 comprises a third tongue 317, a sixth groove 318 and a seventh groove 319.

The first groove 311 is configured for receiving the first tongue 333 of another such panel, wherein a locking is provided in the direction perpendicular to the panel surface. The second groove 312 is configured for receiving the second tongue 314 of another such panel, wherein a locking is provided in the direction perpendicular to the panel surface. The third groove 313 is configured for receiving the third tongue 317 of another such panel, wherein a locking is provided in the direction perpendicular to the panel surface. The fourth groove 315 is configured for receiving the first tongue 333 of another such panel, wherein a locking is provided in the direction perpendicular to the panel surface. The fifth groove 316 is configured for receiving the third tongue 317 of another such panel, wherein a locking is provided in the direction perpendicular to the panel surface. The sixth groove 318 is configured for receiving the first tongue 333 of another such panel, wherein a locking is provided in the direction perpendicular to the panel surface. The seventh groove 319 is configured for receiving the second tongue 314 of another such panel, wherein a locking is provided in the direction perpendicular to the panel surface.

Each of the first edge 302, the second edge 303, the third edge 304 and the fourth edge 305 comprises a closing plane 310. The closing planes 310 are provided substantially perpendicular to the surface of the panel, wherein the closing planes are provided for approaching and preferably for contacting the closing plane of any one of the four edges of another such plane when the panels are in coupled condition.

The first coupling profile 306 comprises a bottom lip 320 extending distally to beyond the closing plane 310 of the first edge. The bottom lip 320 is provided with an upper surface 321 wherein the second coupling profile 307, the third coupling profile 308 and the fourth coupling profile 309 and the upper surface of the bottom lip 321 are configured for establishing a locking—preferably with contact—of the first edge of the panel in the direction perpendicular to the panel surface when the first edge is coupled respectively to the second edge, the third edge or the fourth edge of another such panel.

The second coupling profile 307 comprises proximally from the closing plane of the second edge an upper surface 322. The third coupling profile and the upper surface 322 of the second coupling profile are configured for establishing a locking—preferably with contact—of the second edge of the panel in the direction perpendicular to the panel surface when the second edge is coupled to the third edge of another such panel.

The second locking profile 307 comprises a contact surface 323, substantially parallel with the panel surface. This contact surface 323 is provided proximally from the closing plane of the second locking profile. The second coupling profile 307 and the fourth coupling profile 309 are configured for establishing a locking in the direction perpendicular to the panel surface—preferably with contact—of the panel edge comprising the second coupling profile when coupled to the edge comprising the fourth coupling profile of another such panel by means of the upper surface of the third tongue and the contact surface 323 of the second locking profile.

The four coupling profiles 306, 307, 308, 309 are configured such that they can be milled exclusively by milling with milling tools having an axis perpendicular to the panel surface.

FIGS. 31*a-f* shows the coupling profiles of FIGS. 30*a-d* in coupled condition.

The first coupling profile 306, the second coupling profile 307, the third coupling profile 308 and the fourth coupling profile 309 are configured such that the panel can be coupled at its first edge to anyone one of the first edge, the second edge or the third edge of another such panel; and such that the panel can be coupled at its second edge to anyone of the third edge or the fourth edge of another such panel, and such that the panel can be coupled at its third edge to the fourth edge of another such panel.

Figure 31A:
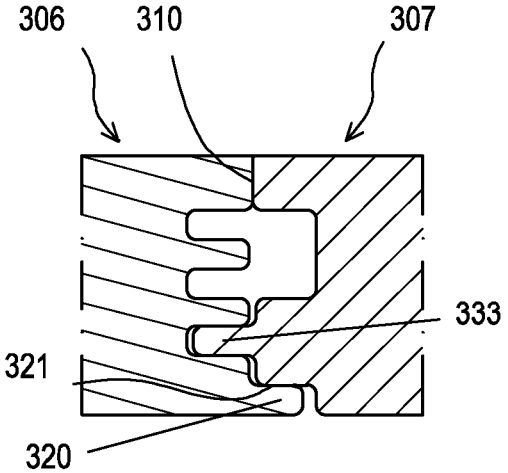
FIGS. 31*a-f* shows the coupling profiles of FIGS. 30*a-d* in coupled condition.
Figure 31B:
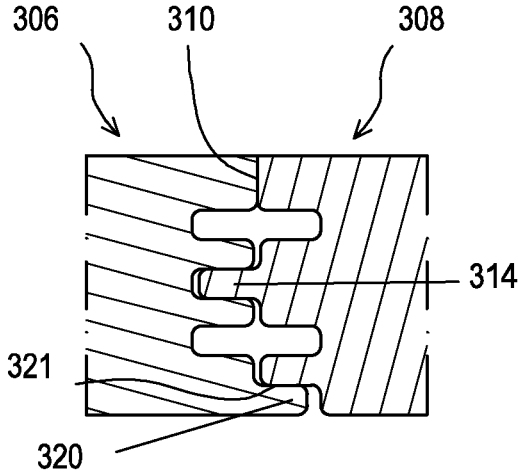
Figure 31C:
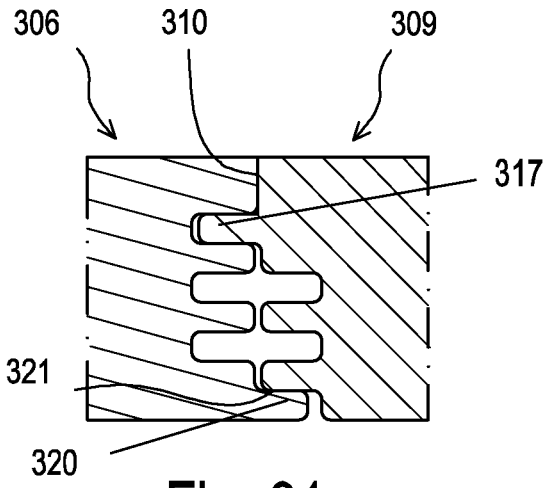
Figure 31D:
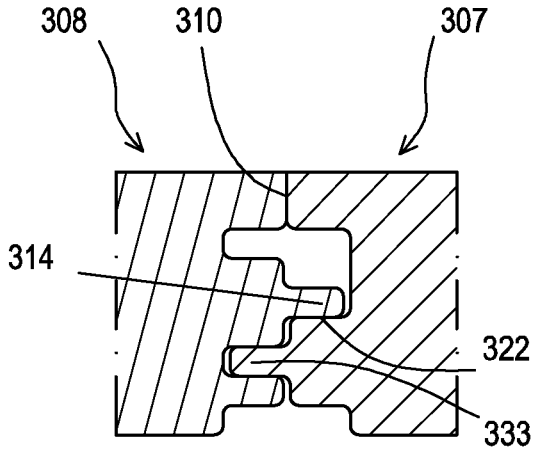
Figure 31E:
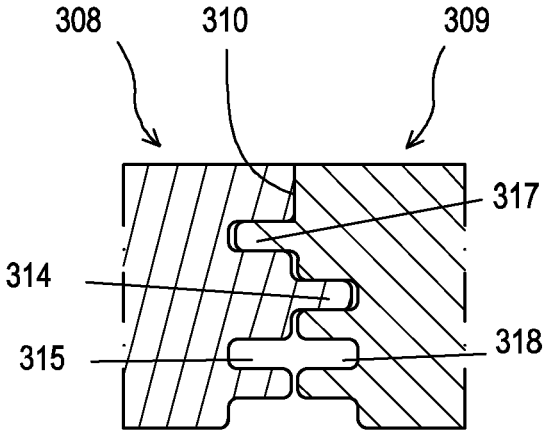
Figure 31F:
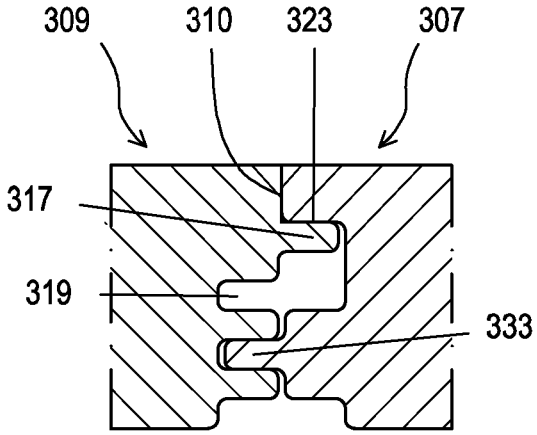

FIG. 31*a* shows the coupling of the panel edge comprising the first coupling profile 306 to the panel edge comprising the second coupling profile 307. FIG. 31*b* shows the coupling of the panel edge comprising the first coupling profile 306 to the panel edge comprising the third coupling profile 308. FIG. 31*c* shows the coupling of the panel edge comprising the first coupling profile 306 to a panel edge comprising the fourth coupling profile 309. FIG. 31*d* shows the coupling of the panel edge comprising the second coupling profile 307 to a panel edge comprising the third coupling profile 308. FIG. 31*e* shows the coupling of the panel edge comprising the third coupling profile 308 to a panel edge comprising the fourth coupling profile 309. FIG. 37*f* shows the coupling of the panel edge comprising the second coupling profile 307 to a panel edge comprising the fourth coupling profile 309.

A locking is provided in the direction perpendicular to the surface of the coupled panels in each of the coupled configurations of two such panels.

In none of the coupled configurations of two such panels, a mechanical locking is provided in the direction perpendicular to the coupled edges and parallel with the surface of the coupled panels.

Thanks to the configuration of the four coupling profiles, the panels according to the ninth aspect of the invention can be installed in laying patterns wherein part of the panels is installed in a 90° angle configuration and wherein part of the panels are installed in linear configuration. Such panels provide a large freedom to select complex installation patterns.

The invention claimed is:

1. A panel, wherein the panel is rectangular, square or oblong, wherein the panel comprises a first edge and a third edge, wherein the first edge and the third edges are provided opposite to each other, wherein the panel comprises a second edge and a fourth edge wherein the second edge and the fourth edge are provided opposite to each other, wherein each of the first edge, the second edge, the third edge and the fourth edge comprise a profile selected from a first profile, a second profile and a third profile, wherein the first profile, the second profile and the third profile are configured such that a panel edge comprising the first profile can be coupled to the edge of another such panel wherein the edge of the another such panel comprises any one of the second profile or the third profile, wherein in a coupled condition a locking of the coupled edges is provided in a direction perpendicular to the coupled panels as well as in a direction perpendicular to the coupled edges and parallel with a surface of the coupled panels; and such that a panel edge comprising the second profile can be coupled to the edge of another such panel wherein the edge of the another such panel comprises the third profile, wherein in the coupled condition a locking of the coupled edges is provided in the direction perpendicular to the coupled panels as well as in the direction perpendicular to the coupled edges and parallel with the surface of the coupled panels;

wherein the first profile comprises a groove;

wherein the groove is bordered by a lower lip and by an upper lip, wherein the lower lip extends distally to beyond the upper lip;

wherein the lower lip comprises a locking element, at its distal end, wherein the locking element of the lower lip of the first profile is provided for realizing a locking in the direction perpendicular to the coupled edges and parallel with a panel surface when a panel edge comprising the first profile is coupled to the edge of another such panel when said edge of the another such panel comprises any one of the second profile or the third profile;

wherein the upper lip comprises a locking surface for establishing a locking in the direction perpendicular to the panel surface when a panel edge comprising the first profile is coupled to the edge of another such panel when said edge of the another such panel comprises the third profile;

wherein the second profile comprises a tongue;

wherein the tongue of the second profile is configured for insertion in the groove of the first profile of an edge of another such panel, thereby establishing a locking in the direction perpendicular to the surface of the coupled panels, wherein the tongue of the second profile comprises a first recess;

wherein the first recess is suited for cooperation with the locking element of the first profile of an edge of another such panel thereby establishing a locking of the coupled panels in the direction perpendicular to the coupled edges and parallel with the panel surface;

wherein the tongue of the second profile comprises a second recess;

wherein the second recess is suited for cooperation with a locking element of the third profile of an edge of another such panel thereby establishing a locking of the coupled panels in the direction perpendicular to the coupled edges and parallel with the panel surface;

wherein the second profile comprises a locking surface, wherein the locking surface is closer to the panel surface than a location of the tongue of the second profile, wherein said locking surface of the second profile establishes a locking in the direction perpendicular to the panel surface when a panel edge comprising the second profile is coupled to the edge of another such panel when said edge of the another such panel comprises the third profile;

wherein the third profile comprises a first tongue and a second tongue;

wherein the second tongue is provided closer to the panel surface than the first tongue of the third profile;

wherein a second groove is provided between the first tongue and the second tongue of the third profile;

wherein the first tongue of the third profile comprises at its bottom a recess;

wherein the recess of the first tongue is provided for establishing, in cooperation with the locking element of the lower lip of the first profile, a locking in the direction perpendicular to the coupled edges and parallel with the surface of the panel when a panel edge comprising the third profile is coupled onto the edge comprising the first profile of another such panel;

wherein the second tongue comprises a locking surface for establishing a locking in the direction perpendicular to the surface of the panels in combination with the locking surface of the first profile or the locking surface of the second profile, when a panel edge comprising the third profile is coupled to an edge of another such panel comprising the first profile respectively the second profile;

wherein the first tongue or the second tongue comprises the locking element of the third profile;

wherein the locking element of the third profile is provided for establishing in combination with the second recess of the second profile a locking in the direction perpendicular to the coupled edges and parallel with the panel surface when a panel edge comprising the third profile is coupled to the edge comprising the second profile of another such panel;

wherein the first recess and the second recess are provided at a same side of the tongue of the second profile.

2. The panel as in claim 1, wherein the locking element of the lower lip of the first profile is directed upwards.

3. The panel as in claim 1, wherein the locking surface of the upper lip of the first profile is provided at an upper surface of an additional groove, the locking surface of the upper lip is closer to the panel surface than the groove of the first profile.

4. The panel as in claim 1, wherein the locking surface of the upper lip of the first profile is provided as an inclined surface at the distal edge of the upper lip.

5. The panel as in claim 1, wherein the locking surface of the second profile is provided at an upper side of an undercut in the second profile.

6. The panel as in claim 1, wherein an upper surface of the second tongue provides the locking surface of the third profile.

7. The panel as in claim 1, wherein the locking surface of the second tongue is provided by a separate insert inserted in the second tongue, wherein the insert is configured such that a displacement of the locking surface by a displacement or elastic deformation of at least part of the insert during the coupling of the panel edges provides for said locking in the direction perpendicular to the surface of the panel.

8. The panel as in claim 1, wherein in coupled condition of an edge comprising the first profile to an edge comprising the second profile of another such panel, the lower lip of the first profile contacts the second profile of an edge of the another such panel in two distinct zones, wherein a gap is provided between said two distinct zones.

9. The panel as in claim 1, wherein in coupled condition of an edge comprising the first profile to an edge comprising the third profile of another such panel, the lower lip of the first profile contacts a bottom of the tongue of the second profile of the edge of the another such panel in two distinct zones, wherein a gap is provided between said two distinct zones.

10. The panel as in claim 1, wherein the first profile, the second profile and the third profile extend continuously and without interruption along the edge where they are provided.

11. The panel as in claim 1, wherein the first profile, the second profile and the third profile have a constant cross section perpendicularly to the edge where they are provided, over a full length of the edge where they are provided.

12. The panel as in claim 1, wherein the first profile, the second profile and the third profile extend along a full length of the panel edge where they are provided.

13. The panel as in claim 1, wherein the panel is oblong and wherein both short edges are provided with the same profile.

14. The panel as in claim 1, wherein the first recess and the second recess are provided at a bottom of the tongue of the second profile.

15. A panel, wherein the panel is rectangular, square or oblong, wherein the panel comprises a first edge and a third edge;

wherein the first edge and the third edges are provided opposite to each other;

wherein the panel comprises a second edge and a fourth edge wherein the second edge and the fourth edge are provided opposite to each other;

wherein each of the first edge, the second edge, the third edge and the fourth edge comprise a profile selected from a first profile, a second profile and a third profile;

wherein the first profile, the second profile and the third profile are configured such that a panel edge comprising the first profile can be coupled to the edge of another such panel wherein the edge of the another such panel comprises any one of the second profile or the third profile;

wherein in a coupled condition a locking of the coupled edges is provided in a direction perpendicular to the coupled panels as well as in a direction perpendicular to the coupled edges and parallel with a surface of the coupled panels; and such that a panel edge comprising the second profile can be coupled to the edge of another such panel wherein the edge of the another such panel comprises the third profile;

wherein in the coupled condition a locking of the coupled edges is provided in the direction perpendicular to the coupled panels as well as in the direction perpendicular to the coupled edges and parallel with the surface of the coupled panels;

wherein the first profile comprises a groove;

wherein the groove is bordered by a lower lip and by an upper lip, wherein the lower lip extends distally to beyond the upper lip;

wherein the lower lip comprises a locking element, at its distal end, wherein the locking element is provided for realizing a locking in the direction perpendicular to the coupled edges and parallel with a panel surface when a panel edge comprising the first profile is coupled to the edge of another such panel when said edge of the another such panel comprises any one of the second profile or the third profile;

wherein the upper lip comprises a locking surface for establishing a locking in the direction perpendicular to the panel surface when a panel edge comprising the first profile is coupled to the edge of another such panel when said edge of the another such panel comprises the third profile;

wherein the second profile comprises a tongue;

wherein the tongue of the second profile is configured for insertion in the groove of the first profile of an edge of another such panel, thereby establishing a locking in the direction perpendicular to the surface of the coupled panels;

wherein the tongue of the second profile comprises a first recess;

wherein the first recess is suited for cooperation with the locking element of the first profile of an edge of another such panel thereby establishing a locking of the coupled panels in the direction perpendicular to the coupled edges and parallel with the panel surface;

wherein the tongue of the second profile comprises a second recess;

wherein the second recess is suited for cooperation with a locking element of the third profile of an edge of another such panel thereby establishing a locking of the coupled panels in the direction perpendicular to the coupled edges and parallel with the panel surface;

wherein the second profile comprises a locking surface for establishing a locking in the direction perpendicular to the panel surface when a panel edge comprising the second profile is coupled to the edge of another such panel when said edge of the another such panel comprises the third profile, wherein said locking surface of the second profile is closer to the panel surface than a location of the tongue of the second profile;

wherein the third profile comprises a first tongue and a second tongue; wherein the second tongue is provided closer to the panel surface than the first tongue of the third profile;

wherein a second groove is provided between the first tongue and the second tongue of the third profile;

wherein the first tongue of the third profile comprises at its bottom a recess;

wherein the recess is provided for establishing, in cooperation with the locking element of the lower lip of the first profile, a locking in the direction perpendicular to the coupled edges and parallel with the surface of the panel when a panel edge comprising the third profile is coupled onto the edge comprising the first profile of another such panel;

wherein the second tongue comprises a locking surface for establishing a locking in the direction perpendicular to the surface of the panels in combination with the locking surface of the first profile or the locking surface of the second profile, when a panel edge comprising the third profile is coupled to an edge of another such panel comprising the first profile respectively the second profile;

wherein the first tongue or the second tongue of the third profile comprises the locking element of the third profile;

wherein the locking element of the third profile is provided for establishing in combination with the second recess of the second profile a locking in the direction perpendicular to the coupled edges and parallel with the panel surface when a panel edge comprising the third profile is coupled to the edge comprising the second profile of another such panel;

wherein in coupled condition of an edge comprising the first profile to an edge comprising the second profile of another such panel, a gap is provided between the upper surface of the locking element of the first profile and the edge of the another panel.

16. The panel as in claim 15, wherein the locking element of the lower lip of the first profile is directed upwards.

17. The panel as in claim 15, wherein the first recess and the second recess are provided at different sides of the tongue of the second profile, wherein the first recess is provided at the bottom of the tongue of the second profile, or wherein the first recess and the second recess are provided at a same side of the tongue of the second profile, wherein the first recess and the second recess are provided at a bottom of the tongue of the second profile.

18. The panel as in claim 15, wherein the locking surface of the upper lip of the first profile is provided at an upper surface of an additional groove, the locking surface of upper lip of the first profile is closer to the panel surface than the groove of the first profile.

19. The panel as in claim 15, wherein the locking surface of the upper lip of the first profile is provided as an inclined surface at the distal edge of the upper lip.

* * * * *